US006481160B1

(12) United States Patent
Kowalczyk

(10) Patent No.: US 6,481,160 B1
(45) **Date of Patent: *Nov. 19, 2002**

(54) AXIAL DOOR OPERATOR

(75) Inventor: Thomas M. Kowalczyk, Farmington, CT (US)

(73) Assignee: The Stanley Works, New Britain, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 74 days.

(21) Appl. No.: 09/631,106

(22) Filed: Aug. 1, 2000

Related U.S. Application Data

(63) Continuation-in-part of application No. 09/497,729, filed on Feb. 4, 2000, and a continuation-in-part of application No. 09/497,730, filed on Feb. 4, 2000

(60) Provisional application No. 60/148,100, filed on Aug. 10, 1999, and provisional application No. 60/118,791, filed on Feb. 4, 1999.

(51) Int. Cl.[7] ..... E05F 11/00

(52) U.S. Cl. ..... 49/335; 49/333

(58) Field of Search ..... 49/324, 330, 331, 49/332, 333, 334, 335, 339, 340

(56) References Cited

U.S. PATENT DOCUMENTS

| | | | |
|---|---|---|---|
| 1,278,148 | A | 9/1918 | Haviland |
| 1,927,559 | A | 9/1933 | Talen |
| 1,986,639 | A | 1/1935 | Konn |
| 2,276,039 | A | 3/1942 | Horther |
| 3,020,038 | A | 2/1962 | Simpson |
| 3,087,720 | A | 4/1963 | Catlett |
| 3,114,541 | A | 12/1963 | Coffey |
| 3,237,932 | A | 3/1966 | Catlett |

FOREIGN PATENT DOCUMENTS

| | | |
|---|---|---|
| DE | 32 02 930 | 8/1983 |
| EP | 0 544 254 | 6/1993 |
| FR | 2 664 644 | 1/1992 |
| GB | 1270355 | 4/1972 |

(List continued on next page.)

*Primary Examiner*—Daniel P. Stodola
*Assistant Examiner*—Hugh B. Thompson
(74) *Attorney, Agent, or Firm*—Pillsbury Winthrop LLP

(57) ABSTRACT

The present application discloses an axial operator that is configured for use with a door assembly. The axial operator comprises a rotatable operator output member that rotates about an operator axis, the operator output member being constructed and arranged to be operatively connected within the door assembly such that the operator output axis extends generally vertically. An electric motor has a rotatable motor output member that rotates about the operator axis. The motor is constructed and arranged to selectively rotate the motor output member about the operator axis. A reduction transmission is connected between the motor output member and the operator output member. The reduction transmission is constructed and arranged such that the transmission rotates the operator output member at a lower rotational speed than a rotational speed at which the motor rotates the motor output member and applies a higher torque to the operator output member than a torque which the motor applies to the motor output member. The reduction transmission comprises (a) an orbit gear, (b) a planet gear carrier, and (c) a planet gear. The motor is adapted to be communicated to a controller so as to receive a door moving signal therefrom and being further adapted to selectively rotate the motor output member in response to receiving the door moving signal to thereby rotate the operator output member so as to move the door panel with respect to the doorway as aforesaid.

44 Claims, 27 Drawing Sheets

U.S. PATENT DOCUMENTS 3,422,704 A 1/1969 Catlett
3,425,161 A 2/1969 Catlett et al.
3,457,674 A 7/1969 Catlett et al.
3,605,339 A 9/1971 Catlett et al.
3,625,328 A 12/1971 Carli
3,668,737 A 6/1972 Tillmann
3,675,370 A 7/1972 Catlett
3,760,455 A 9/1973 Berry et al.
3,834,081 A 9/1974 Catlett
4,045,914 A 9/1977 Catlett
4,134,231 A 1/1979 Daugirdas et al.
4,220,051 A 9/1980 Catlett
4,231,192 A 11/1980 Daugiras et al.
4,333,270 A 6/1982 Catlett
4,367,610 A 1/1983 Goode
4,501,090 A 2/1985 Yoshida et al.
4,565,030 A 1/1986 LaSance
4,581,849 A 4/1986 Schwarz
4,599,824 A 7/1986 Mitsuhashi et al.
4,660,322 A 4/1987 Lowe
4,727,679 A 3/1988 Kornbrekke et al.
4,744,125 A 5/1988 Scheck et al.
4,785,493 A 11/1988 Tillmann et al.
5,193,647 A 3/1993 O'Brien, II
5,221,239 A 6/1993 Catlett
5,386,885 A 2/1995 Bunzl et al.
5,392,562 A 2/1995 Carambula
5,680,674 A 10/1997 Guthrie
5,878,530 A 3/1999 Eccleston et al.

AXIAL DOOR OPERATOR

The present application claims priority to U.S. Provisional Application of Kowalczyk, Ser. No. 60/148,100, filed Aug. 10, 1999. The present application also claims priority as a continuation-in-part to both U.S. patent applications of Kowalczyk et al., Ser. Nos. 09/497,729 and 09/497,730, both filed Feb. 4, 2000, and both of which in turn claim priority to U.S. Provisional Application of Kowalczyk et al., Ser. No. 60/118,791, filed Feb. 4, 1999. The entirety of each of the applications mentioned in this paragraph are hereby incorporated into the present application by reference.

FIELD OF THE INVENTION

The present invention relates to a door operator for power-operated door assemblies. More specifically, the present invention relates to an axial operator that mounts to a power-operated door assembly in a vertical orientation and that moves one or more door panels of the door assembly.

BACKGROUND TO THE INVENTION

Conventional power-operated door systems typically comprise a frame, one or more door panels, a power-operated door operator for moving the door panel(s) between the open and closed positions thereof, and a controller that controls operation of the door operator. Typically, the door operators comprise an electric or hydraulic motor that rotates a motor output member and a reduction transmission that rotates an operator output member at a lower rotational speed and a higher torque than the motor output member. The operator output member is operatively connected to the door panel(s) so that rotation of the operator under power from the motor affects opening and closing movements of the door panel(s).

Examples of door operators that are designed for use with a swinging or balanced door are disclosed in U.S. Pat. Nos. 3,675,370 and 4,045,914. As can be appreciated from the disclosure of the '914 patent, the axes of the motor and the reduction transmission are oriented horizontally at approximately 90° with respect to the axis of the operator output member. This arrangement is provided to give the door operator a somewhat low vertical profile and so that it can be encased out of view in an overhead header that extends across the top of the frame assembly. However, because the motor and reduction transmission extend horizontally, the header must be provided with a relatively long horizontal dimension to house these components. Even though the header is provided with a low vertical profile, it still has a relatively large size compared to the size of other structural components in the frame assembly and hence can look aesthetically unbalanced. In this type of arrangement, it would be desirable from both an aesthetics viewpoint and a functional viewpoint to reduce header size or eliminate the header altogether. From a functional viewpoint, elimination of the header would increase the amount of available vertical height for the frame's doorway without increasing the overall height of the frame.

There are also known swing door assemblies that have no header on the frame thereof. For example, U.S. Pat. No. 5,878,530 discloses a swing door assembly in which the motor and reduction gear arrangement thereof are housed in a box-like housing that is carried by the door panel. Movement of the door panel relative to the frame is affected via a linkage arrangement. One end of the linkage arrangement is connected to the top rail of the frame and the other end is connected to the reduction transmission carried within the housing on the door panel. While this arrangement eliminates the need for a header on the frame, it simply replaces the header with a housing carried on the door panel. As with the header, the size of the housing is determined by the components housed therein and it would be desirable to reduce the size of the housing or eliminate it entirely to improve the overall aesthetics of the door assembly.

U.S. Pat. No. 3,834,081 discloses a door operator for a sliding door assembly that connects to a chain and sprocket arrangement. Operation of the door operator in the '081 patent imparts rotational movement to the chain and sprocket assembly to thereby move the door panel(s) between the open and closed positions thereof. As with the arrangement of the above-mentioned '914 patent, the operator and chain/sprocket arrangement of the '081 patent are both housed in an overhead header with the operator extending horizontally over the top of the chain/sprocket arrangement. As a result, the vertical dimension of the header is determined both by the vertical extent of the chain/sprocket arrangement and the vertical extent of the operator. As with the arrangement described above in the '914 patent with references to swing doors, reducing the vertical dimension of the header would improve the functional and aesthetic characteristics of the sliding door assembly's frame.

As has been noted above with respect to various types of door assemblies, there is a desire to decrease the overall size of the structures that house the door operator and its associated components. In fact, it would be desirable to eliminate such housing structures entirely, if possible. To achieve this, it is necessary in turn to reduce the overall size of the door operator. Further, this door operator size reduction must be achieved without sacrificing the output torque of the operator. To date, no door operator has been provided in the art that achieves these goals.

Consequently, there exists a need in the art for an improved door operator that is both compact in size and has a sufficiently high torque output to enable it to be effectively used for moving the door panel(s) of a power-operated door assembly.

SUMMARY OF THE INVENTION

It is an object of the present invention to meet the above-described need. To achieve this object, the present invention provides a power-operated door assembly comprising a frame assembly, a door panel, and an axial operator. The frame assembly installs in an opening formed through a building wall and provides a doorway that permits persons to travel from one side of the building wall to the other side of the building wall. The door panel extends generally vertically and moves with respect to the doorway of the frame assembly. The power-operated door assembly may be a swing door, a sliding door, a bi-fold door, a balanced door, or a revolving door assembly, or any other type of power-operated door assembly.

The axial operator comprise a rotatable operator output member that rotates about a generally vertically extending operator axis. The operator output member is operatively connected within the door assembly such that rotation of the operator output member moves the door panel with respect to the doorway of the frame assembly as aforesaid. The operator also comprises an electric motor that has a rotatable motor output member that rotates about the operator axis. The motor selectively rotates the motor output member about the operator axis. A planet gear reduction transmission is connected between the motor output member and the operator output member. The reduction transmission is constructed and arranged such that the transmission rotates the operator output member at a lower rotational speed than a rotational speed at which the motor rotates the motor output member and applies a higher torque to the operator output member than a torque which the motor applies to the motor output member.

In particular, planet gear reduction transmission comprises (a) an orbit gear arranged generally coaxially with respect to the operator axis, (b) a planet gear carrier positioned radially inwardly of the orbit gear and arranged for rotation about the operator axis, and (c) a planet gear for each carrier the planet gear carrier has a mounting portion offset generally radially from the operator axis and the planet gear is rotatably mounted to the mounting portion of each planet gear carrier such that the planet gear rotates about a planet gear axis that extends through the mounting portion generally parallel to the operator axis. The planet gear is operatively connected to the motor output member and engaged with the orbit gear such that rotating the motor output member rotates the planet gear about its planet gear axis, which in turn causes the planet gear to rolling along the interior surface of the orbit gear in a generally circumferential direction with respect to the operator axis. This causes the planet gear carrier to rotate about the output axis at a lower rotational speed and at a higher torque than the rotational speed and torque at which the motor rotates the motor output member. The planet gear carrier is operatively connected to the operator output member such that rotation of the planet gear carrier as a result of the planet gear being rotated by the motor output member as aforesaid rotates the operator output member as aforesaid to thereby move the door panel with respect to the doorway of the frame assembly.

The number of planet gears and planet gear carriers of the reduction transmission may be varied to achieve a desired reduction gear ratio. Also, the dimensions of the orbit gears, planet gears, and gear carriers may likewise be varied to achieve a desired reduction gear ratio.

The door assembly of the present invention also comprises a controller communicated to the motor of the axial operator. The controller is operable to selectively control operation of the motor so as to selectively cause the motor to rotate the motor output member and thereby rotate the operator output member so as to move the door panel with respect to the doorway as aforesaid.

A related aspect of the invention relates to the axial door operator for use in a power-operated door assembly. This operator may be built into a pre-fabricated power-operated door assembly or may be provided as part of a retrofitting kit along with the controller for mounting to a standard non-powered residential or commercial door assembly to thereby convert the non-powered door assembly into a powered one.

Other objects, features, and advantages of the present invention will become apparent from the following detailed description, the accompanying drawings, and the appended claims.

DETAILED DESCRIPTION OF THE PREFERRED EMBODIMENT OF THE INVENTION

Figure 1:
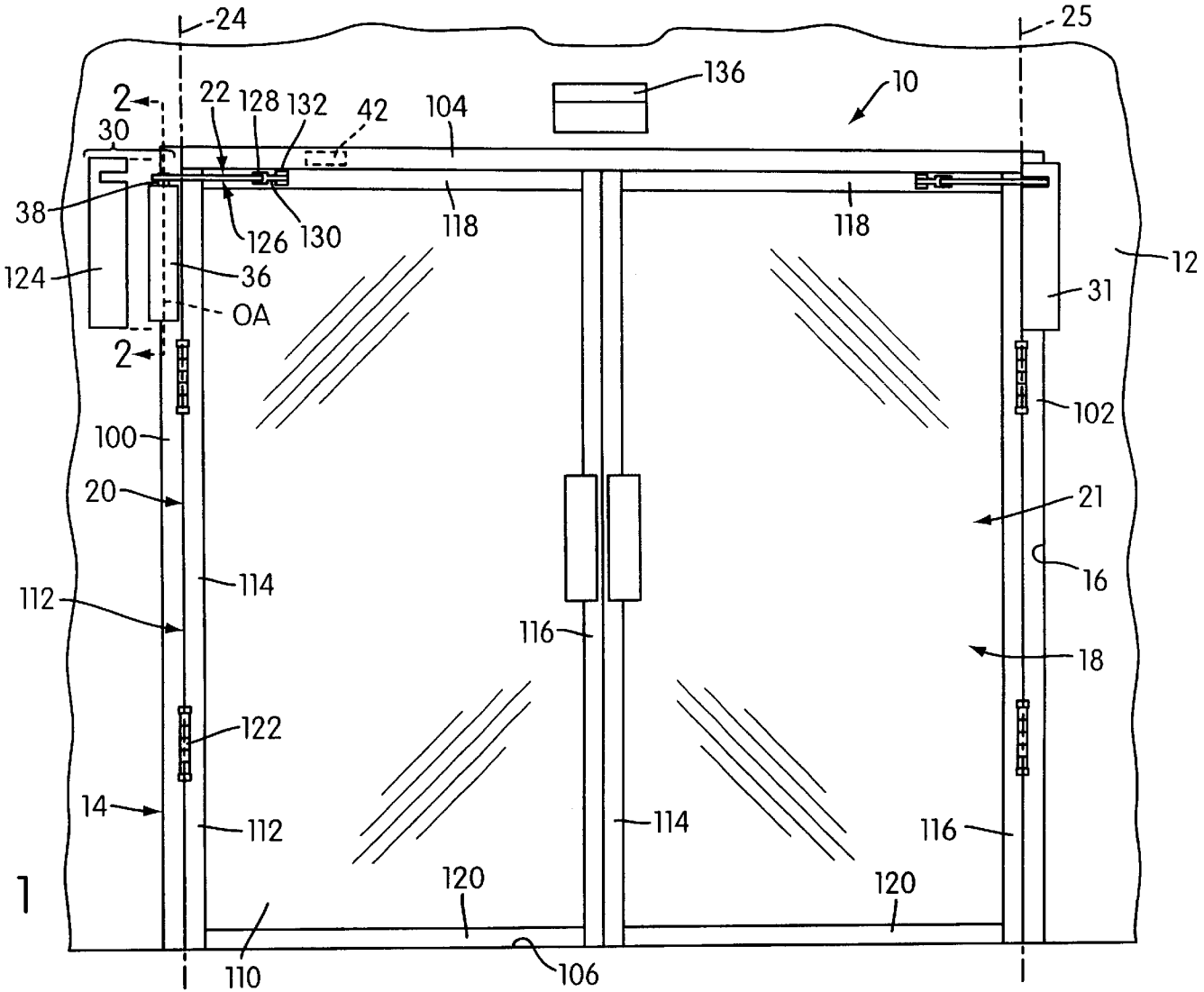
FIG. 1 shows a front elevational view of a pivoting-type door assembly constructed according to the principles of the present invention mounted in a building wall shown in fragmentary view and shows a cover member in exploded relation with an axial operator of the door assembly.

FIG. 1 shows a power operated door assembly (also referred to as a power-operated door assembly), generally designated 10, constructed according to the principles of the present invention. The door assembly 10 is shown mounted in a building wall 12 and includes a frame assembly 14 that installs in an opening 16 formed through the building wall 12. The frame assembly 14 provides a doorway 18 that permits persons to travel from one side of the building wall 12 to the other side of the building wall 12 when the door assembly 10 is installed in opening 16.

A generally vertically extending door panel 20 mounts to the frame assembly 14 for movement between an open position wherein the door panel 20 allows travel through the doorway 18 and a closed position (FIG. 1) wherein the door panel 20 restricts travel through the doorway 18.

The door assembly 10 shown in FIG. 1 is generally of the swinging type and is exemplary only. Specifically, the door panel 20 is a swinging door panel that pivots about a generally vertically extending axis 24 between its open and closed positions. The door assembly 10 of FIG. 1 is a double door. The door panel 20 is paired with a second door panel 21 that pivots about a generally vertically extending axis 25 located on the opposite side of the doorway 18. The door panels 20, 21, the mounting hardware for each door panel 20, 21 and the opening and closing hardware associated with each door panel 20, 21 are of mirror image construction. Therefore only the structure and operation of the door panel 20 will be considered in detail, but the discussion applies equally to door panel 21.

A door moving structure, generally designated 22, is operatively associated with the door panel 20 and acts to move the same between its open and closed positions. The door moving structure 22 is constructed and arranged such that imparting torque or rotation to the door moving structure 22 about a generally vertically extending axis causes the door panel 20 to move between its open and closed positions.

The mechanical power required to move the door panel 20 between its open and closed positions is provided by an axial operator 30 (see FIG. 1, for example) mounted on the frame assembly 14 and operatively connected to the door panel 20 through the door moving structure 22 (in a manner considered below). The structure of the axial operator 30 is considered immediately below and then the operation of the axial operator 30 to open and close door panels in a wide variety of door assemblies is considered thereafter.

Figure 2:
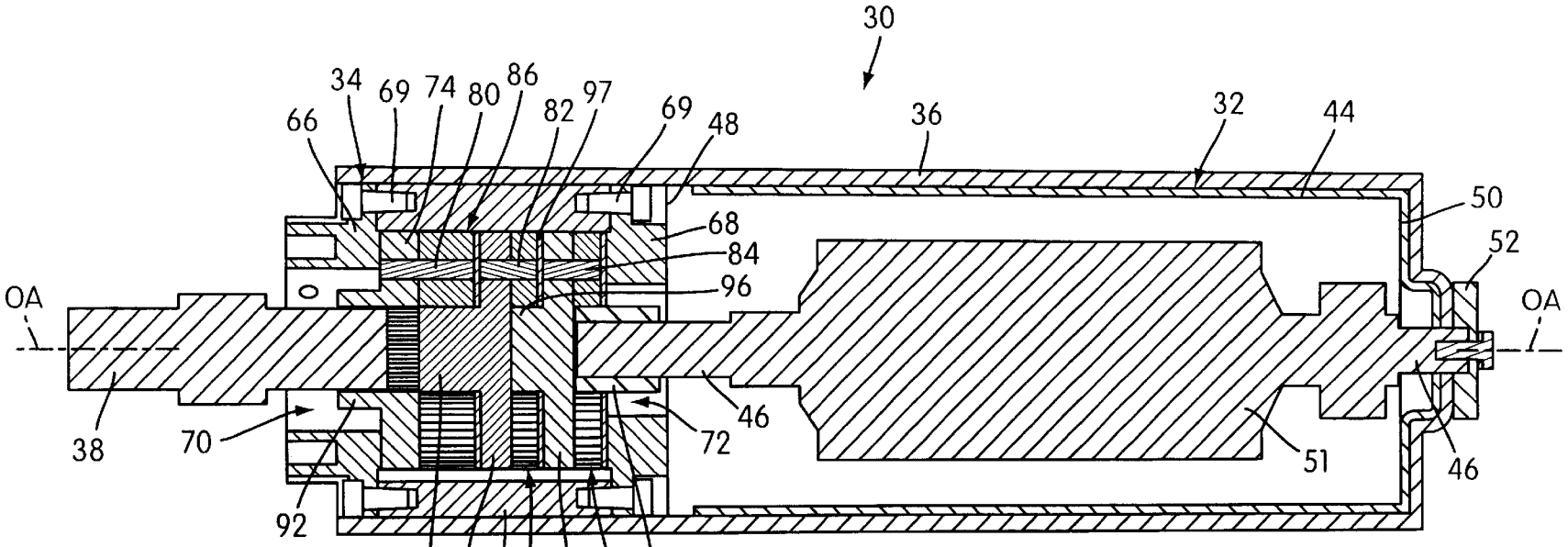
FIG. 2 shows cross sectional view of the axial operator taken through the line 2—2 of FIG. 1.
Figure 3:
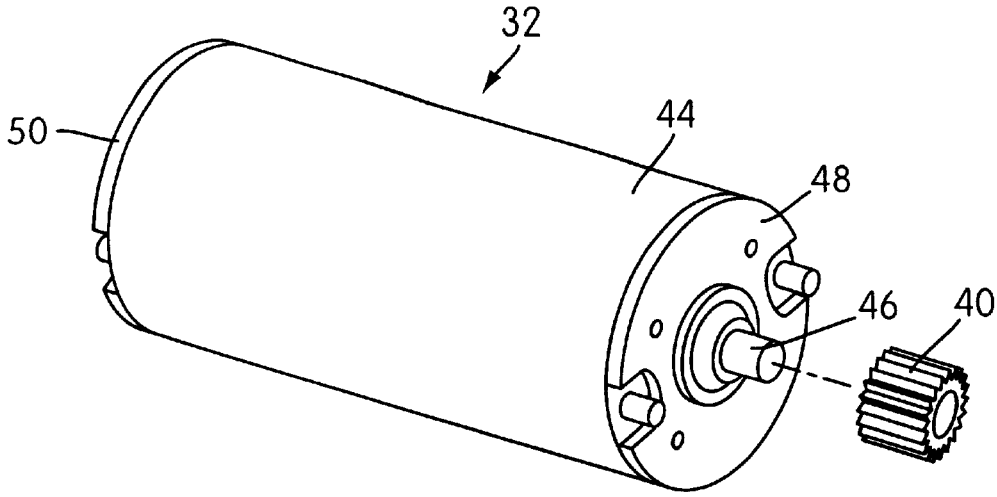
FIG. 3 shows a front perspective view of a motor of the axial operator and shows a motor output member exploded relation with the motor.

The construction of the axial operator 30 can be best understood from FIGS. 2 and 3. The axial operator 30 includes a reversible electric motor 32, a rotatable operator output member 38 and a reduction transmission 34 mounted in torque-transmitting relation between the motor 32 and the operator output member 38. The motor 32 and reduction transmission 34 are housed within a cylindrical casing or housing 36.

FIG. 2 shows a cross-sectional view of the assembled axial operator 30. The operator output member 38 extends outwardly from the reduction transmission 34 and rotates about an operator axis OA (FIG. 2). It can be appreciated from FIG. 1, for example, that when the axial operator 30 is mounted in the door assembly 10, the operator output member 38 (and the operator axis OA defined by the member 38) extends generally parallel to the door moving axis 24.

The operator output member 38 is operatively connected to the door moving structure 22 such that rotating the operator output member 38 under power moves or swings the door panel 20 between its open and closed positions. With respect to the swinging door panel 20, the operator output member 38 is operatively connected with the door moving structure 22 such that rotation of the operator output member 38 in a first rotational direction moves the door panel 20 towards and into its fully open position and such that rotation of the operator output member 38 in a second rotational direction opposite the first rotational direction moves the door panel 20 towards and into its closed position.

The reversible electric motor 32 shown is preferably a conventional D.C. motor 32. The motor 32 has a rotatable motor output member 40 that is co-axial with the operator axis OA so that the motor output member 40 rotates about the operator axis OA when the motor 32 is energized. The motor 32 is communicated to a controller 42 (shown schematically in FIG. 1) and is adapted to receive signals from and send feedback signals to the controller 42. Electrical signals transmitted from the controller 42 control operation of the motor 32 in a manner that is well-known in the art.

D.C. motors are widely commercially available and the construction and operation of such motors are well known. Hence, the details of the motor 32 are not considered in specific detail in the present application. Preferably, the motor 116 is of the type in which the direction of the rotation of the motor output member 40 can be reversed by reversing the direction of the current flowing to the motor 116. The controller 42 is in electrical communication with the motor 32 through conventional electroconductive wires (not shown) and is used in a manner well known to those skilled in the art to control the motor 32 operation and to switch the direction of the motor current.

Figure 4:
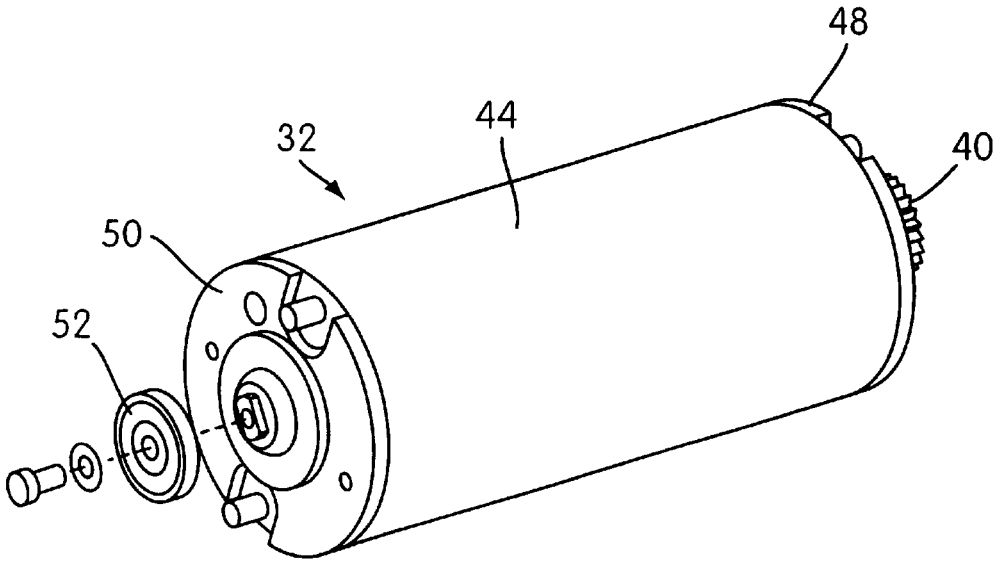
FIG. 4 shows a rear perspective view of the motor of FIG. 3 and shows portions thereof in exploded relation therewith.

The motor 32 is shown in isolation in FIGS. 3 and 4. The D.C. motor 32 is housed in a cylindrical casing 44. A motor drive shaft 46 extends thorough front and rear wall portions 48, 50 of the casing 44 and is driven by an armature assembly 51 of well known construction (shown schematically inside the casing 44 in FIG. 2). The motor output member 40 is fixedly mounted to one end of the shaft 46. The preferred motor output member 40 is a spur or pinion gear.

An annular member 52 is fixedly mounted to an opposite end of the shaft 46 for rotation therewith. Magnetic material is evenly spaced about the outer periphery of the circular member 52 and a metering device (not shown) is mounted on the end of the shaft 46 of the motor casing 44. The metering device includes a Hall effect sensor which generates a Hall effect feedback signal when the magnetic material is rotated by the motor shaft 46. The Hall effect signal is fed back to the controller 42 through conventional wires (not shown) to indicate, for example, the angular speed of the motor shaft 46 and the angular position of the door panel 20 with respect to the frame assembly 14. The construction and use of Hall effect sensors is well known in the art and will not be considered in detail in the present application.

The reduction transmission 34 is operatively connected in torque transmitting relation between the motor output member 40 and the operator output member 38. The reduction transmission 34 is constructed and arranged such that the transmission 34 rotates the operator output member 38 at a lower rotational speed than a rotational speed at which the motor 32 rotates the motor output member 40 and applies a higher torque to the operator output member 38 than a torque which the motor 32 applies to the motor output member 40.

Figure 5:
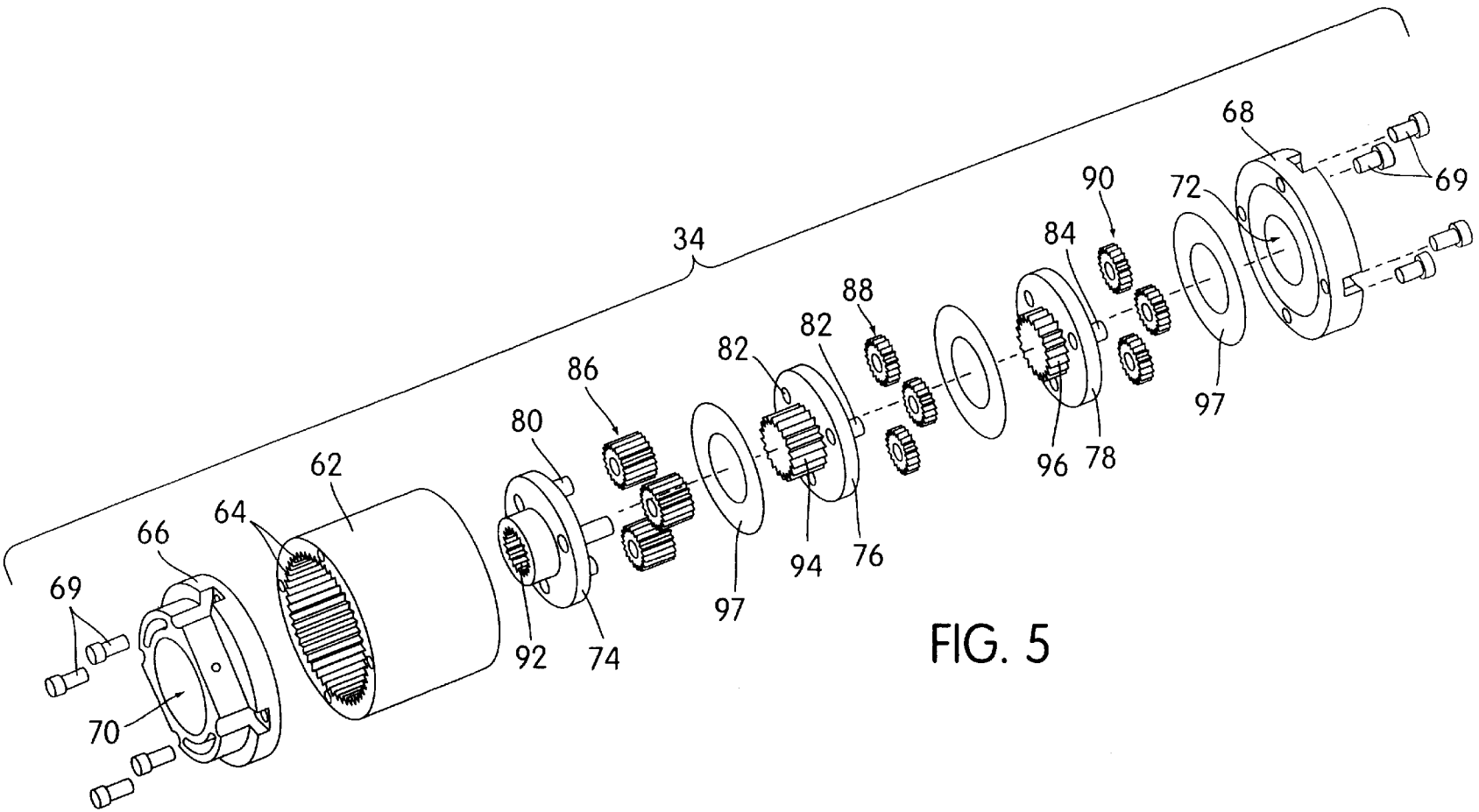
FIG. 5 shows an exploded view of a reduction transmission of the axial operator.
Figure 6:
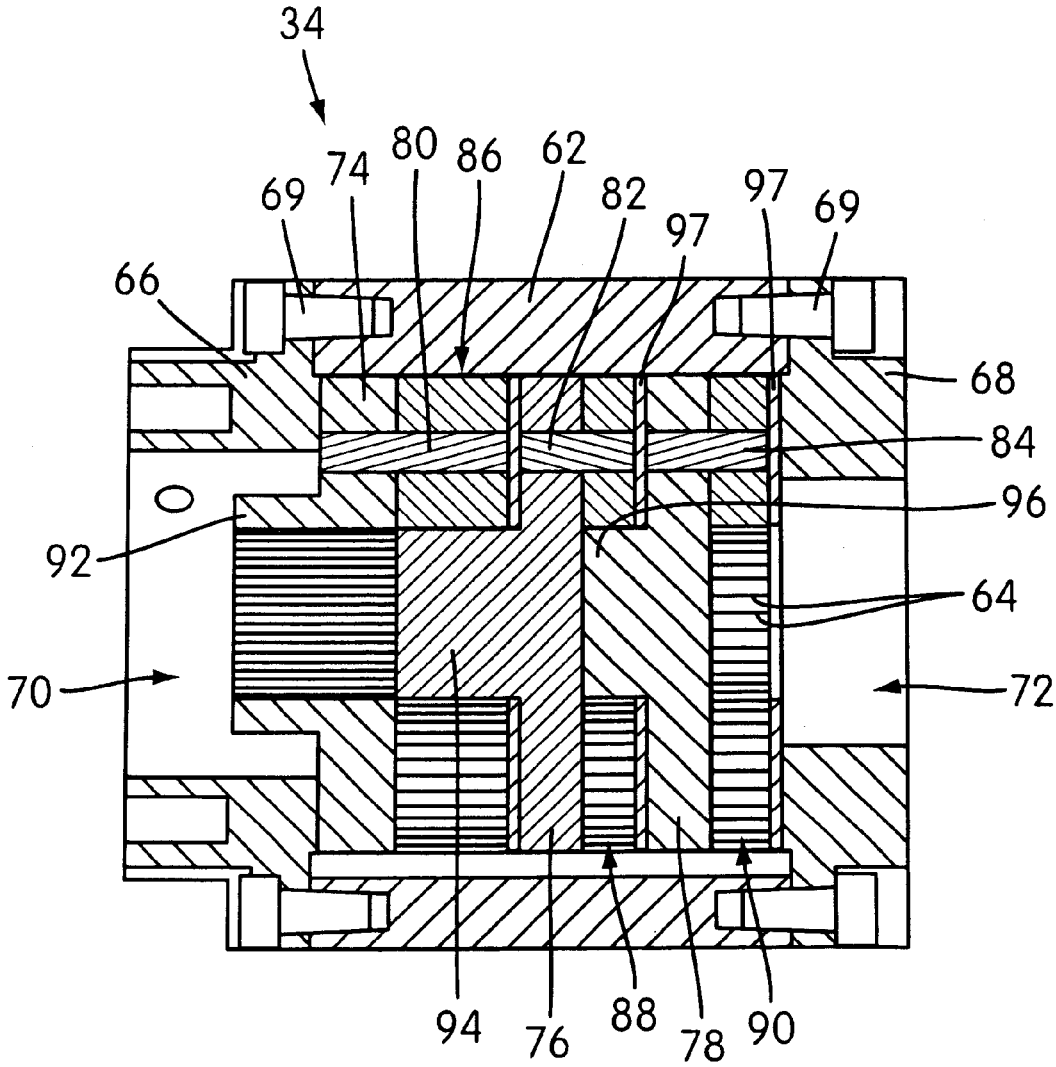
FIG. 6 shows a cross sectional view of the reduction transmission in isolation.

The construction of the reduction transmission 34 can be best appreciated from FIGS. 5 and 6 which show the reduction transmission 34 in isolation from the remaining components of the operator. The reduction transmission 34 includes a generally cylindrical outer housing 62, the interior of which is splined to provide a set of axially extending gear teeth 64 defining a ring or orbit gear. Annular front and rear covers, 66 and 68, respectively, are secured to respective ends of the outer housing 62 with threaded fasteners 69 to close the front and rear ends of the housing 62. The covers 66, 68 each have a central opening 70, 72, respectively, to provide access to the interior of the reduction transmission 34.

Three planet gear carriers 74, 76, 78 are disposed inside the housing 62 and rotate about the operator axis OA. Each planet gear carrier 74, 76, 78 has a set of mounting portions in the form of planet gear mounting pins extending rearwardly therefrom. The three sets of mounting pins are designated 80, 82, 84, respectively. Each mounting pin of each set 80, 82, 84 extends generally in an axial direction from its respective planet gear carrier 74, 76, 78 so that each pin is generally parallel to the operator axis OA of the axial operator 30. Preferably, there are three pins in each set 80, 82, 84 and the pins of each set are circumferentially spaced evenly about the operator axis OA of the axial operator 30.

Three sets of three planet gears, generally designated 86, 88, 90, are rotatably mounted on the sets of planet gear mounting pins 80, 82, 84, respectively (such that one gear is mounted on each pin). Although the illustrated embodiment shows three carriers each carrying three planet gears, the number of carriers, the number of gears carried by any individual carrier and the diameters of the gears and carriers may be varied to achieve the desired reduction ratio. In the illustrated embodiment, the speed reduction ratio achieved is approximately 42.6:1 from the input of the reduction transmission 34 to the output of the reduction transmission 34. The ratio may be increased for applications in door assemblies having door panels of greater weight which require more torsional force to move between open and closed positions. Conversely, the ratio may be decreased for door assemblies with lighter door panels which require less torsional force to affect opening and closing movement.

Each planet gear carrier 74, 76, 78 has a carrier output member 92, 94, 96. The carrier output members 94, 96 of the rear and central carriers 76, 78 are provided by pinion gears integrally formed on the forward face of the respective carrier. The output member 92 on the forward carrier 74 is a splined bore having a series of axially extending, gear engaging teeth.

When the transmission 34 is assembled, the planet gears of each gear set 86, 88, 90 are intermeshed with the teeth 64 of the housing 62. When the operator 30 is assembled, the drive shaft 46 of the motor 32 extends through the opening 72 in the rear cover 68 and the axially extending teeth of the motor output member 40 are intermeshed with the teeth of the planet gears of set 90. Rotation of the motor output member 40 rotates the planet gears of set 90 about their respective axes (formed by the mounting pins 84) which causes the gear set 90 to travel circumferentially (i.e., revolve) about the operator axis (axis OA) in intermeshed relation with the teeth 64 of the housing 62. The circumferential travel of the planet gears of set 90 about the transmission axis causes the rear carrier 78 to rotate about the operator axis OA at a rate that is slower than the rate at which the motor output member 40 rotates about the axis OA.

The planets gears of the gear set 84 are intermeshed with both the output member 96 integrally formed on the rear carrier 78 and with the teeth 64 on the interior of the housing 62. Rotation of planet gear carrier 78 causes the planet gears of the gear set 88 to rotate about their respective axes (provided by mounting pins 82), which in turn causes the planet gears of the gear set 88 to travel circumferentially with respect to the operator axis OA in intermeshed relation with the teeth of the housing 62 (i.e., the orbit gear). This circumferential travel of the gears of gear set 88 rotates the central carrier 76 about the operator axis OA at a rate that is slower than the rotational rate at which the rear planet gear carrier 78 rotates about the axis OA.

In like manner, the planet gears of the gear set 86 are in intermeshed relation both with the teeth of the output member 94 of the central carrier 76 and with the interior teeth 64 of the housing 62 such that rotation of central planet gear carrier 76 rotates the planet gears of the gear set 86 about their respective axes (provided by the mounting pins 80), which in turn causes the planet gears of the gear set 86 to travel circumferentially with respect to the operator axis OA in intermeshed relation with the teeth 64 on the interior of the housing 62. As with carriers 76 and 78, this circumferential travel of the gear set 86 rotates the forward gear carrier 74 about the operator axis OA at a rate that is slower than the rotational rate at which the central planet gear carrier 76 rotates about the axis OA.

The invention may be practiced without the use of intermeshed teeth. Instead, the various gears may be frictionally engaged with one another without the use of teeth. Metal washers 97 are provided to prevent frictional wear of the planet gear sets.

The operator output member 38 extends through the opening 70 in the front cover 66 and is received within the splined bore that defines the output member 92 of the forward carrier 74. The intermeshing of the teeth on the rearward end portion 98 of the operator output member 38 with the teeth of the output member 92 prevents angular displacement of the operator output member 38 with respect to the carrier 74 during power operated door movement so that the operator output member 38 and forward carrier 74 rotate about the operator axis OA as a single unit. As will become apparent, rotation of the operator output member 30 imparts torque to the door moving structure 22 to affect door panel movement. It can be appreciated that the output member 92 of the forward carrier 74 may be considered to function as the output of the reduction transmission 34.

Because each successive planet gear set 90, 88, 86 rotates more slowly than the previous output member (40, 96, 94, respectively) which drives the same, the rotational speed of the operator output member 38 at the output of the reduction transmission 34 is significantly lower than the rotational speed of the motor output member 40 secured to the shaft 46 of the motor 32. As a result, the torque at the output of the reduction transmission 34 is greater than the effective torque of the motor 32. The decease of the rate of rotation and increase in torsional force provided by the reduction transmission 34 allows high speed/low torque motors (which are less expensive and smaller than low speed/high torque motors) to be used to drive movement of doors having weights which the motor 32 alone could not effectively drive.

As is considered in greater detail below, a controlling system (including the controller 42 and the Hall effect sensor) communicated to the motor 32 of the axial operator 30 is operable to selectively control operation of the motor 32 so as to rotate the operator output member 38 in either the first or the second output rotational direction thereof to thereby move the door panel 20 toward and into either the open position thereof or the closed position thereof, respectively.

The reduction transmission 34 is secured to the motor 32 by a pair of axially extending threaded fasteners (not shown) that extend through the length of the motor casing 44 and that are received within threaded bores (not shown) formed in the rear cover 68 of the reduction transmission 34. The manner in which threaded fasteners are used to secure the reduction transmission 34 to the motor 32 is shown in each of United States Patent Application of Kowalczyk, et al., Serial No. 60/118,791, Ser. Nos. 09/497,729 and 09/497,730 which patent applications are hereby incorporated into the present application in its entirety for all material disclosed therein.

The reduction transmission 34 and the motor 32 (secured together by fasteners as described) are mounted within the cylindrical casing 36 by threaded fasteners that extend through the bottom of the cylindrical casing 36 and threadedly engage the casing 44 on the motor 32. The cylindrical outer casing 36 is a protective metal sleeve preferably formed either by extrusion or a rollforming and seam-welding operation. Apertures (not shown) are formed in the outer casing 36 for passage of electrically conducting wires from the motor 32 to a source of power and from the Hall effect sensor to the controller 42.

It can be understood that because the axial operator 30 is relatively small and provides a relatively high reduction ratio (42.6:1 in the exemplary axial operator 30, as previously noted) in a compact package, the axial operator 30 can be easily installed in a door assembly in a wide variety of door assembly locations and orientations in operative association with the door moving structure 22.

The small size, light weight, low cost and high output power of the axial operator 30 provides a wide range of installation options for door assembly manufacturers. As will become apparent, the small size and high output power of the axial operator 30 allows the door manufacturer to provide low profile or headerless door assemblies for a wide variety of applications, particularly commercial applications. Low profile door systems improve doorway and building aesthetics and maximize the usable size of the clearance opening provided by the associated doorways when the door panels thereof are open.

The invention contemplates that the door panel could be both opened and closed under power, or a return spring could be utilized to drive the door opposite the direction in which the operator drives the door. That is, the operator could open the door under power with the spring providing the closing force, or the operator could close the door under power with the spring providing the opening force.

Pivoting Door Assemblies

Examples of ways in which the axial operator 30 can be used in power operation of pivoting-type door assemblies are shown in FIGS. 1 and 7–13. These examples are intended to convey broad teachings of the invention and to be illustrative only and are not intended to limit the scope of the invention.

With reference to FIG. 1, the frame assembly 14 includes a pair of extruded metal jambs 100, 102, an extruded metal header 104 and a metal threshold structure 106. The jambs 100, 102 are secured to the wall 12 on respective opposite sides of the doorway 18 and the header 104 and threshold structure 106 are secured to the wall 12 and ground surface 108 respectively, and to adjacent ends of the jambs 100, 102. The door panel 20 includes a glass panel 110 and a metallic frame 112 mounted thereabout. The metallic frame 112 includes vertically extending extruded metal stiles 114, 116 and upper and lower rails 118, 120, respectively.

The door jambs 100, 102 and the header 104 are tubular members, preferably made of a metal of appropriate strength by extrusion or other suitable method. The door panel 20 is pivotally secured to the jamb 100 by hinges 122 which form the aforementioned vertical pivot axis 24 of the door panel 20 with respect to the frame assembly 14. The axial operator 30 is mounted to the jamb 100 by a bracket or the like and is normally covered by cover member 124 (shown in exploded relation with the axial operator 30 in FIG. 1 and not shown in FIGS. 7 and 8 to more clearly show the structure of the axial operator 30). The door moving structure 22 is comprised of a linkage arm member 126 having a main arm portion 128 and compensator arm portion 130. One end of the main arm portion 128 is rigidly secured to the operator output member 38 for pivotal movement therewith. The compensator arm 130 is pivotally mounted between an end of the main arm portion 130 opposite the operator output member 38 and a bracket 132 on the top rail 118 of the door panel 20.

The axial operator 30 is electrically communicated with an electrical power source (not shown) and the controller 42 controls the flow of electricity from the power source to the operator 30. Supplying a direct electrical current to the motor 32 drives the motor shaft in a conventional manner to rotate the motor output member 40 about the operator axis OA. The controller 42 may be mounted in the interior of the header 104 (as shown in dashed lines in FIG. 1) or in any other interior portion of the frame assembly 14 or in the cavity of the adjacent wall 12. An infrared detector 136 and the Hall effect sensor are electrically communicated with the controller 42. When a person approaches the doorway 18 and the door panels 20, 21 are closed, the presence of the approaching person is detected by the infrared detector 136 which in turn sends an appropriate signal to the controller 42 to initiate the door opening process. In response, the controller 42 energizes the motor 32 causing the motor 34 to rotate the motor output member 40 about the operator axis in a door opening direction. This in turn rotates the operator output member 38 about the operator axis OA through the reduction transmission 34 to move the door panel 20 in an opening manner.

In the exemplary embodiment of the door assembly 10, each door panel 20, 21 is operatively connected with an individual axial operator, designated 30 and 31. The axial operators 30, 31 are identical and are designated by different numbers to facilitate discussion of the door assembly 10 only. It is assumed that the controller 42 is programmed to operate the axial operators 30, 31 simultaneously to open and close both doors together. Consequently, only the operation of the door panel 20 will be discussed in detail. It is understood that the axial operator 30 can be used in a door assembly having a single door panel. When two door panels are provided on a single door assembly (as in FIG. 1, for example), the controller 42 can be programmed to operate the door panels 20, 21 independently.

Rotation of the operator output member 38 in the door opening direction moves the main arm portion 128 of the door moving structure 22 in the door opening direction about the operator axis OA, thereby causing the door to move from its closed position toward and into its open position. As best understood from a comparison of the top view of the door assembly 10 in FIGS. 7 and 8, the compensator arm 130 compensates for the fact that the operator axis and the vertical pivot axis of the door panel 20 defined by the hinges 122 are parallel but are not co-extension.

As the door panel 20 moves from its closed to its open position, the controller 42 monitors the speed and angular position of the same by monitoring the Hall effect counts. When the door panel 20 is in its open position (determined, for example, by the number of revolutions of the motor output member 40 in the opening direction), the controller 42 switches off the power to the motor 32 in the axial operator 30, and then, if no people are detected by the infrared detector 136 in the vicinity of the door assembly 10 for a predetermined time, the controller 42 energizes the motor 32 to close the door assembly 10 in a manner which is essentially the reverse of the opening operation.

The speed at which the door panel 20 moves during opening and closing is determined by both the motor speed and the gear ratios chosen for the particular reduction transmission 34. The axial operator 30 may be used to construct door assemblies in a modular manner. That is, a plurality of axial operators having a wide range of gear ratios, motor speeds and powers may be constructed and inventoried to provide a door manufacturer and/or door installer with a range of axial operator choices for a particular door opening and closing application. The gear ratio of a reduction transmission can be adjusted by providing a reduction transmission having a different number of gear set and carriers and/or by changing the dimensions size of the gears and so on.

The particular details of the electronic control system used to energize and deenergize the motor 32 considered in detail in the present application either because such details are well-known to those skilled in the art. It is understood that the controller 42 can be programmed to operate the door panels 20, 21 in a variety of ways and also to operate the door panels 20, 21 safely. The controller 42 can be programmed, for example, to open both door panels 20, 21 simultaneously or to open only one door panel 20 or 21, as desired and as appropriate. The controller 42 may, for example, be provided with an appropriate feedback signal and be appropriately programmed to monitor the current going to the motor 32 to detect obstructions which impede opening or closing movement of the moving door panel 20 (which may be indicated by a spike in the motor 32 current). The controller 42 may be programmed to take appropriate action if an obstruction is detected, such as reversing the motor 32 direction or turning the motor 32 off.

It is to be understood that the operator 30 does not necessarily have to be mounted to the frame assembly 14 or door panel 20 and can instead be connected to the two arms of the linkage arm structure 126 to drive the same relative to one another to effect movement of the door panel 20. Thus, it can be broadly stated that the operator 30 may be mounted anywhere within the door assembly 10.

Figure 7:
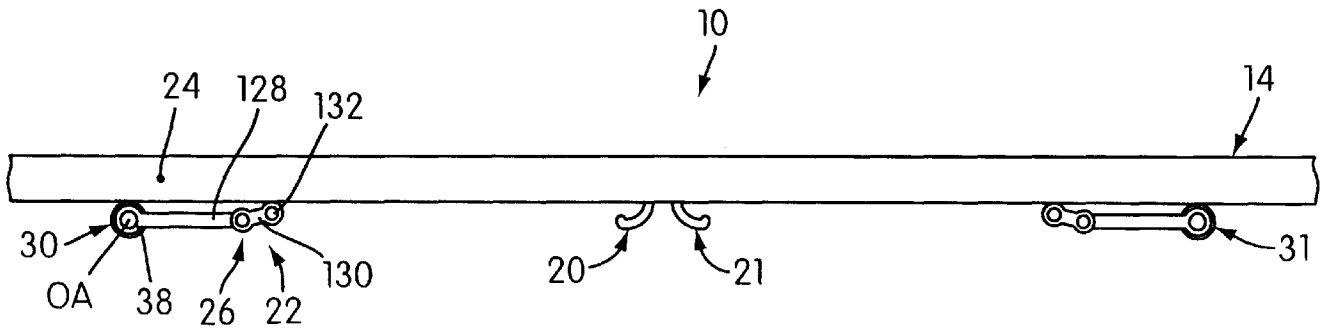
FIG. 7 shows a fragmentary top plan view of the door assembly of FIG. 1 with the cover members removed and a plurality of door panels thereof in a closed position.
Figure 8:
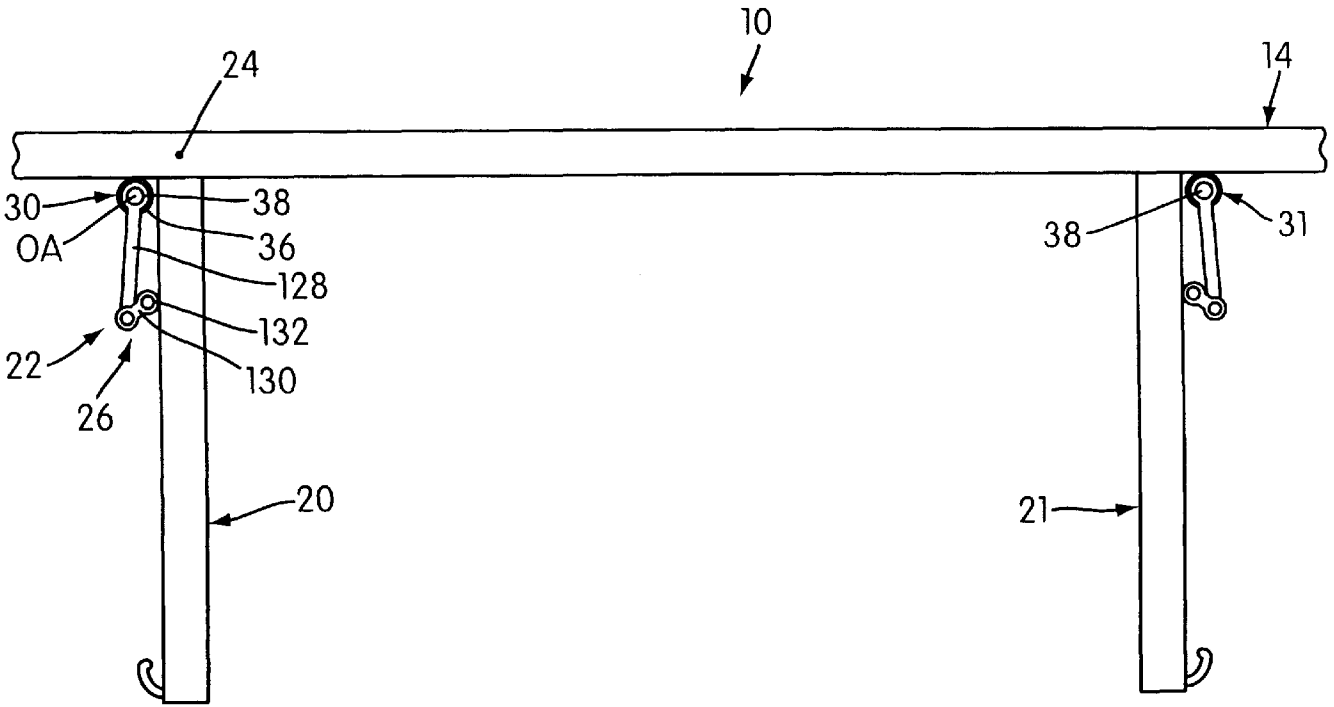
FIG. 8 is a view similar to FIG. 7 except showing the door panels in their open positions.

FIGS. 1, 7 and 8 show that when the axial operator 30 is mounted on a jamb of the frame assembly 14, the header 104 of the frame assembly 14 can have a relatively small vertical extent when viewed from the perspective of FIG. 1 so that the usable open portion of the doorway 18 is maximized. In fact, if the controller 42 is disposed in the wall cavity rather than the header, the header can have the same cross-section as the jambs 100, 102. As a result, the dimensions of the frame assembly look consistent along the periphery thereof and the frame assembly can, in effect, be characterized as "headerless." Further, the header 104 and the jambs 100, 102 can be made using the same extrusion die, thereby reducing manufacturing costs. It can also be understood from FIG. 1 that the door assembly 10 can be manufactured to include the axial operators 30, 31, or alternatively, the axial operators and associated hardware (including the cover members, the door moving structures 22 and the door bracket) can be manufactured for aftermarket installation on a manual door assemblies.

FIGS. 9–13 show in fragmentary view alternative ways in which an axial operator(s) 30 can be mounted in a door assembly and operatively connected with a door panel of the assembly.

Figure 9:
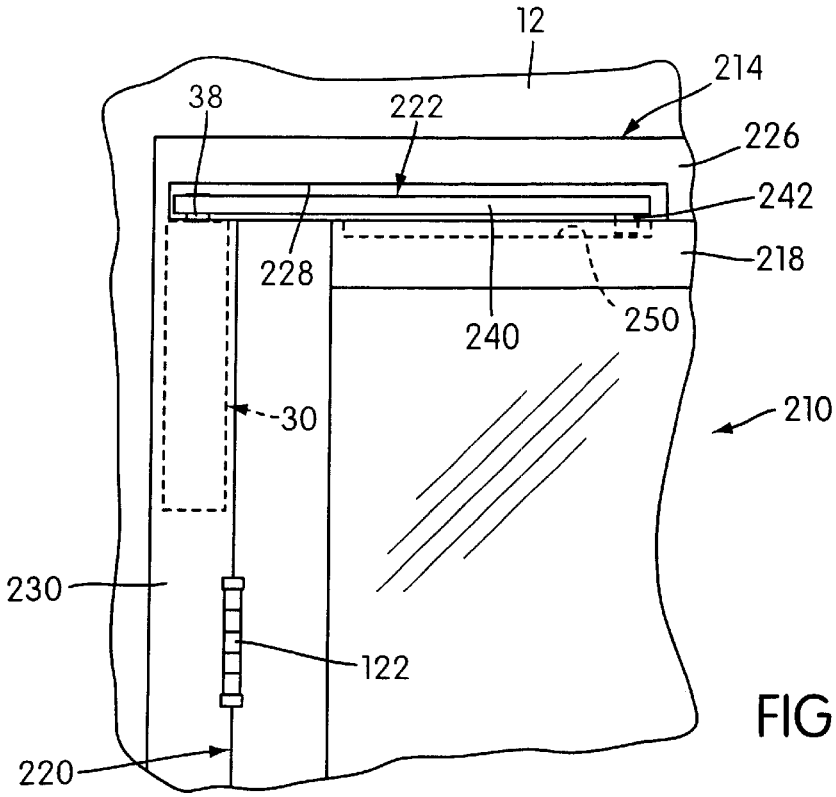
FIG. 9 is a fragmentary view of a pivoting-type door assembly showing an axial operator of the door assembly mounted in a frame assembly portion thereof.

FIG. 9 shows that a door assembly 210 can be manufactured to allow an axial operator 30 to be mounted inside a portion of the frame assembly 214. Identical structures between the door assembly 10 shown in FIGS. 1–8 and the door assemblies shown in the subsequent figures are given identical reference numbers and are not discussed further. The axial operator (or axial operator pair) is identified by reference number 30 (or by reference numbers 30 and 31) in all of the figures, but this is not intended to imply that only one embodiment of the axial operator is contemplated and within the scope of the present invention. It is understood that because of the modular construction and design flexibility of the axial operator, it is within the scope of the invention to provide a range of axial operators for use in a wide range of door assemblies and that the same reference number (i.e., 30) or numbers (i.e., 30 and 31) are used throughout the present application to facilitate discussion of the invention only. The controller, the power source any other portions of the electrical control system are not shown in FIGS. 9–13 to more clearly illustrate the invention.

With continued reference to FIG. 9, a jamb 230 of the door assembly 210 has been constructed with an interior large enough to contain the axial operator 30. The axial operator 30 is mounted therein such that the operator output member 38 extends above the top surface of an top rail 218 of an adjacent door panel 220 mounted on the jamb 230. The header 226 is provided with a narrow slot 228 to accommodate a single rigid arm member 240, one end of which is fixedly attached to the operator output member 38 of the axial operator 30. A vertically extending roller 242 is provided on the opposite end of the arm member 240. The roller 242 is engaged in an upwardly opening slot 250 provided in the top rail 218 of the door panel 220. The arm member 240 and the roller 242 comprise the door moving structure of the door assembly.

The door panel 220 is opened and closed by rotating the operator output member 38 alternately in opening and closing directions (by an electrical control system that is not shown but which may be similar to that used for door assembly 10 of FIGS. 1–8) which in turn pivots the arm 240 about the operator axis OA. This pivotal movement of the arm 240 causes the roller 242 to move in the slot 250 in door panel opening and closing directions. It can be understood that the configuration shown in FIG. 9 can be used in a door assembly having a single door panel or, alternatively, in a door assembly having multiple door panels. For example, two axial operators could be provided in opposite jambs of a single door assembly to open and close opposing door panels. It can also be appreciated that the door panel in FIG. 9 can be provided with a compound hinge so that the axial operator 30 can be used to open the closed door panel in either of two opposite pivotal directions with respect to the frame assembly.

Figure 10:
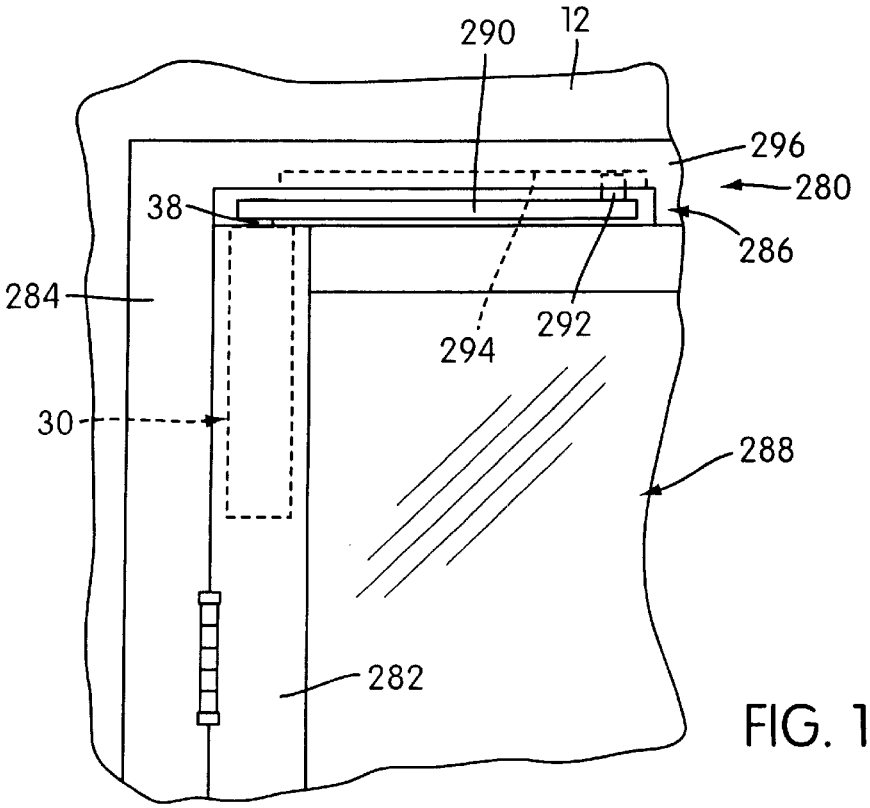
FIG. 10 is a fragmentary view of a pivoting-type door assembly showing an axial operator of the door assembly mounted in a vertically extending stile of the door panel.

FIG. 10 shows an embodiment of a door assembly 280 in which the vertically extending stile 282 adjacent to the associated jamb 284 of the frame assembly 286 is constructed with an interior large enough to contain the axial operator 30. The axial operator 30 is mounted inside the jamb 282 so that the operator output member 38 extends upwardly above the top of the associated stile 282 and is fixedly secured to an arm member 290. A roller 292 on the opposite end of the arm member 290 is mounted within a downwardly opening slot 294 in the header 296 of the frame assembly 286. When the axial operator 30 is energized by a power source controlled by the controller, the arm member 290 pivots with the rotating operator output member 38, causing the roller 292 to move laterally in the slot 294 and engage the sides thereof. As a result of the rollers restricted movement in the slot 294, the pivoting movement of the arm 290 pivots the door panel about the vertical axis defined by its hinges. A compound hinge may be provided sot the door panel 288 can be pivoted from its closed position by the axial operator 30 in opposite opening directions with respect to the frame assembly 286.

Figure 11:
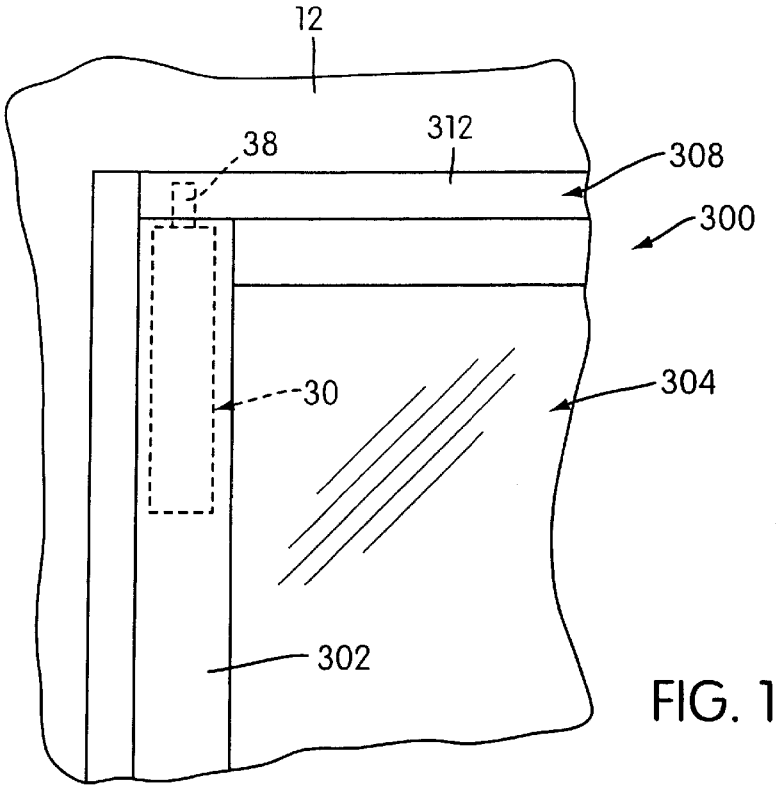
FIG. 11 is a fragmentary view of a pivoting-type door assembly showing another embodiment of the door assembly in which an axial operator is mounted in a vertically extending stile of the door panel.
Figure 12:
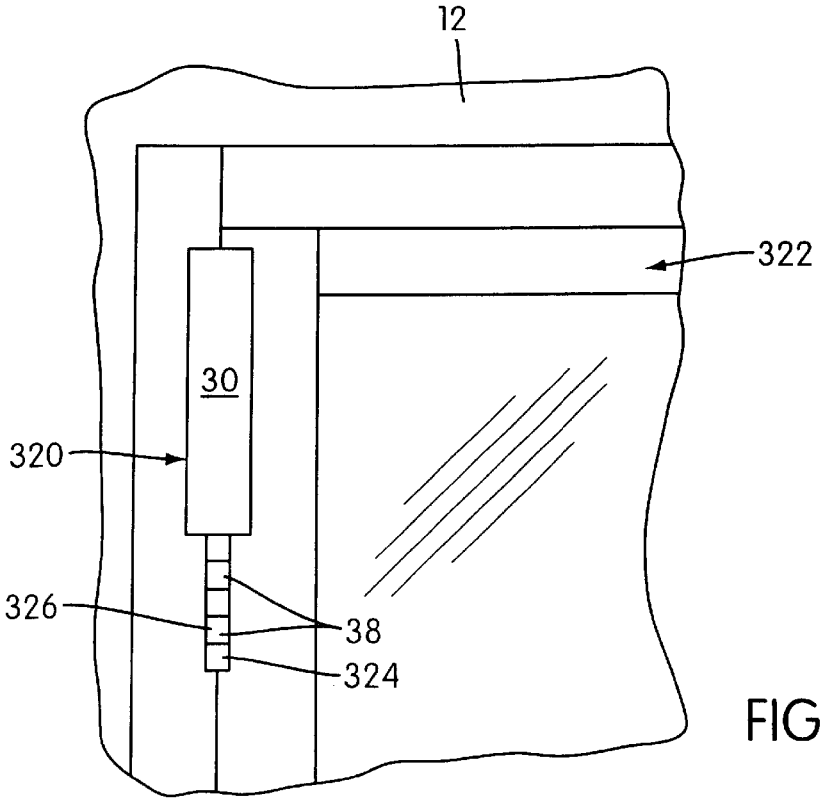
FIG. 12 is a fragmentary view of a pivoting type door assembly showing a motorized hinge structure mounted thereon for door panel opening and closing movement.
Figure 13:
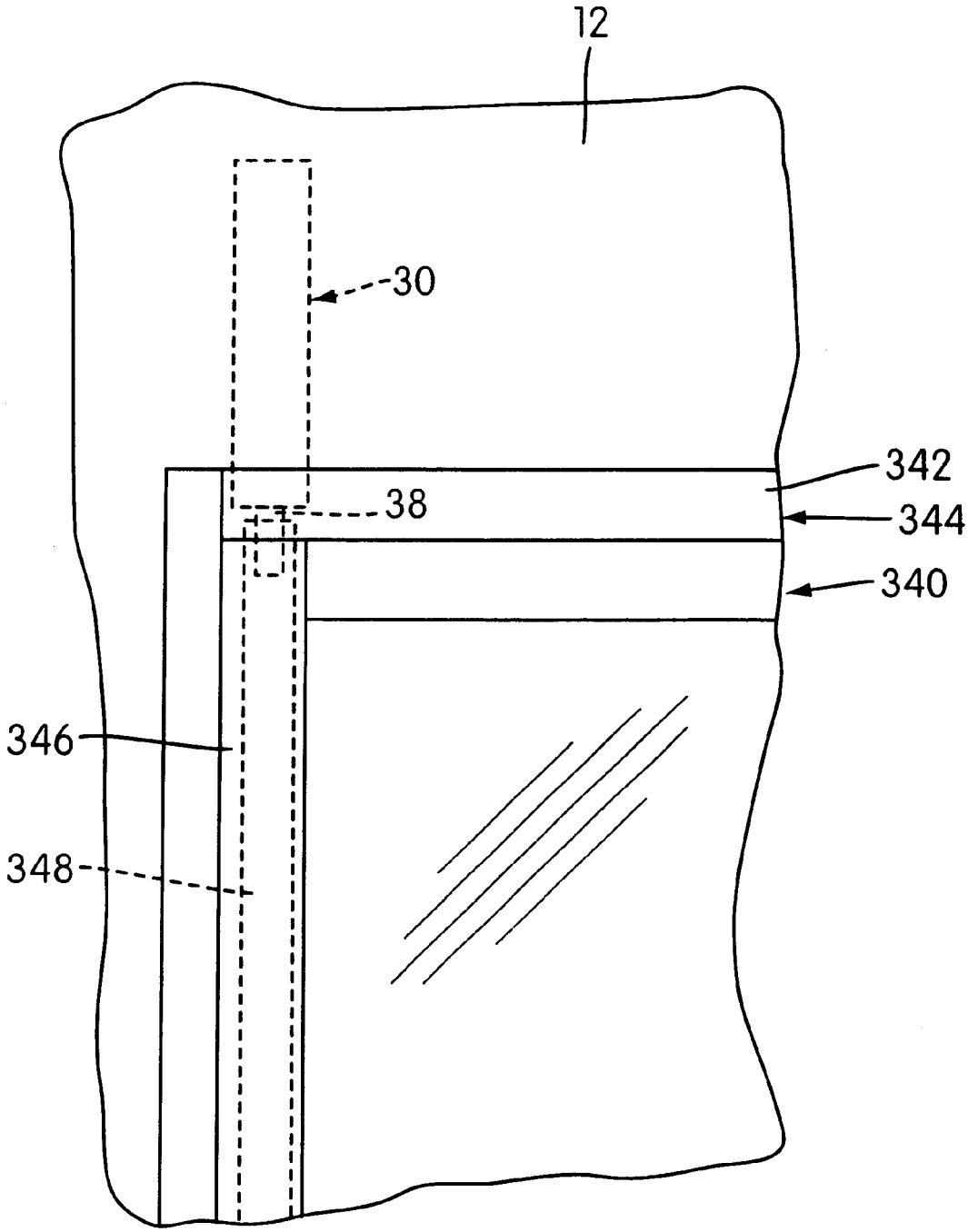
FIG. 13 is a fragmentary view of a pivoting-type door assembly in which an axial operator thereof extends upwardly into an interior portion of a building wall adjacent the door assembly.

FIGS. 11–13 illustrate that the axial operator 30 can be mounted in a door assembly such that the operator axis OA of the operator 30 is co-extensive with the pivot axis of the associated door panel. More particularly, FIG. 11 shows a door assembly 300 in which the vertical stile 302 of the door panel 304 is configured to receive an axial operator 30 internally therein. The axial operator 30 is fixedly mounted in the stile 302 so that its operator output member 38 extends outwardly from an upper end of the stile 302 and into the header 312 of the frame assembly 308. The operator output member 38 is fixedly (i.e., non-rotatably) to a fixed structure mounted in the header 312. When the motor of the axial operator 30 is energized, rotation of the operator output member 38 relative to the casing of the axial operator 30 causes pivotal movement of the door panel 304 with respect to the frame assembly 308 between open and closed positions.

FIG. 12 shows that the axial operator 30 can be used to construct a motorized hinge structure 320 to move an associated door panel 322 between open and closed positions. Specifically, the motorized hinge structure 320 includes to mating hinge half members 324, 326. The first hinge half member 324 is fixedly secured with respect to the reduction transmission, the motor and the casing of the axial operator. The second hinge half member 326 is fixedly attached to the operator output member 38 of the axial operator 30. The first hinge half member 324 is pivotally mounted on the operator output member 38 in hinge forming relation with the second hinge half member 326.

The first hinge half member 324 is fixedly secured to the vertically adjacent jamb of the frame assembly. The second hinge half member 326 is fixedly secured to the adjacent stile of the door panel. The operator output member 38 comprises a hinge pin portion of the motorized hinge structure 320. It can be understood that rotation of the operator output member 38 when the motor of the axial operator is energized causes pivotal movement of the second hinge half member 326 with respect to the first hinge half member 324 to open and close the door panel 304. It can be appreciated that the motorized hinge structure 320 can be mounted on a door assembly specifically manufactured to receive the same or, alternatively, can be manufactured as an aftermarket product to provide power operation of a manually operated pivoting door.

FIG. 13 shows that the axial operator 30 can be installed such that its operator axis OA is co-extensive with the vertical pivot axis of the door panel 340 and such that the length of the axial operator 30 extends upwardly through the header 342 of the frame assembly 344 and into an interior cavity of the wall 12 above the doorway 18 (shown in FIG. 13).

A vertical stile 346 of the door panel 340 receives a pivot shaft 348 in the interior thereof. The shaft 348 extends from the header 342 downwardly into a base portion (not shown) of the frame assembly 344 to pivotally mount the door panel 340 to the frame assembly 344. The pivot shaft 348 is fixedly (i.e. non-rotatably) mounted within the side rail 346 of the door panel 340 so that rotational movement of the pivot shaft 348 by the axial operator 30 causes the pivot shaft 348 and the door panel 340 to pivot together as a unit in an opening or closing direction with respect to the frame assembly 344. Such mounting may be accomplished by providing the pivot shaft with a cross-sectional shape that complements the interior of the stile 346 or by threading fasteners through the stile wall and into the shaft 348. The arrangement shown in FIG. 13 is provided to minimize the vertical height of the header 342.

Figure 14:
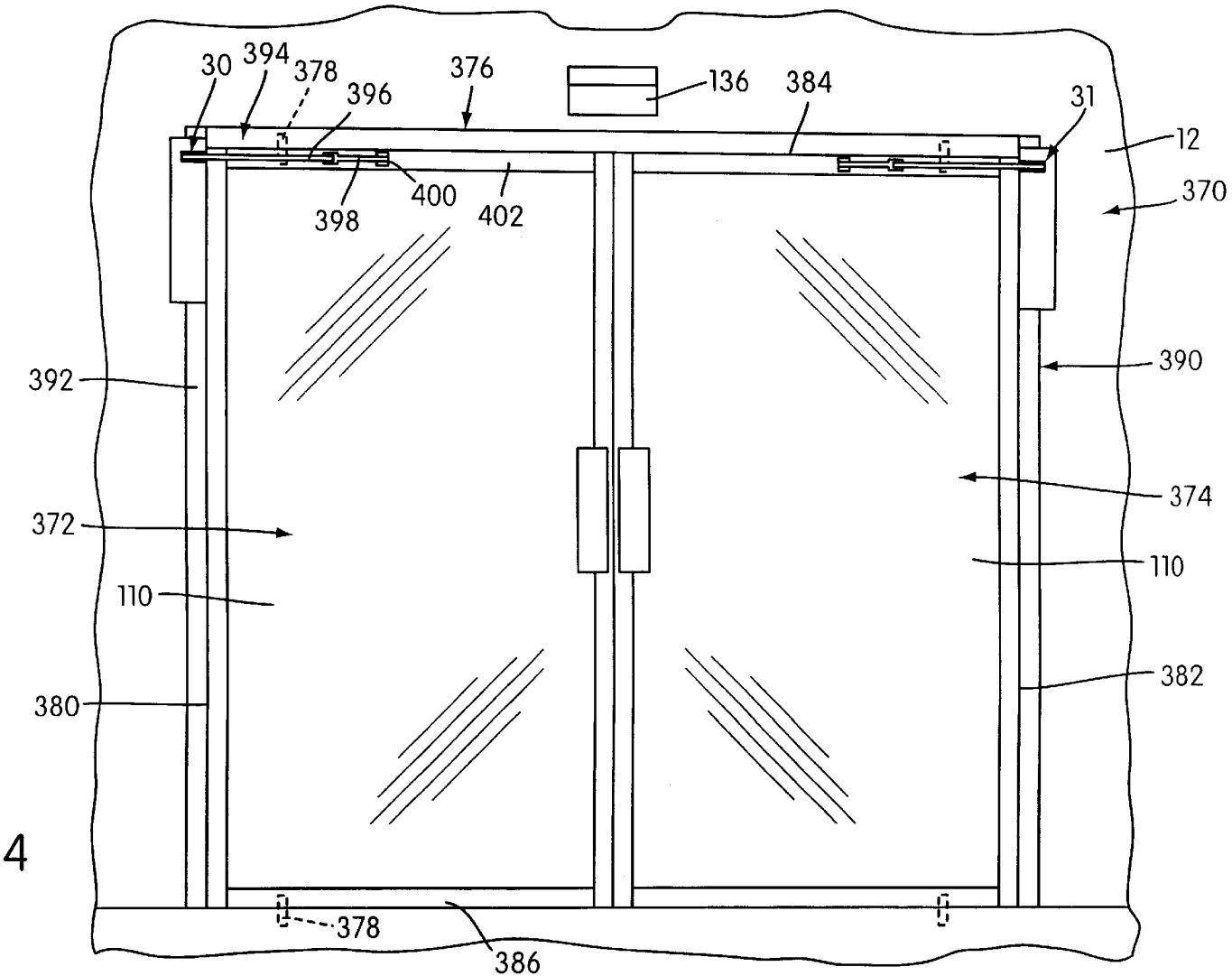
FIG. 14 is a front elevational view of a balanced-type door assembly constructed according to the principles of the present invention.

FIG. 14 shows an arrangement similar to FIG. 1 except that the door assembly 370 of FIG. 14 includes a door panel 372 (and a second door panel 374 paired therewith) of the balanced type. The balanced door panels 372, 374 are pivotally mounted to the frame assembly 376 by generally vertically extending pivot shafts 378 that are positioned inwardly from the stile edges 380, 382, respectively, of the door panels 372, 374 adjacent the frame assembly jambs. This offset positioning of the pivot shaft 378 is typically provided when the glass portion 110 of the door panel 372 is particularly heavy as is often the case in commercially used glass doors. The pivot shafts 378 are pivotally mounted in apertures in both the header 384 and the threshold 386 of the frame assembly 376.

Figure 15:
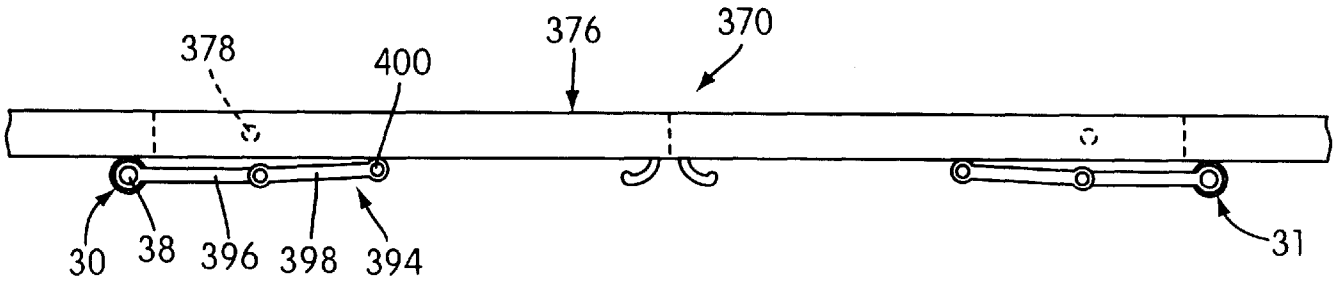
FIG. 15 is a top plan view of the balanced-type door assembly of FIG. 14 with the cover members over the axial operators removed showing a plurality of door panels thereof in a closed position.
Figure 16:
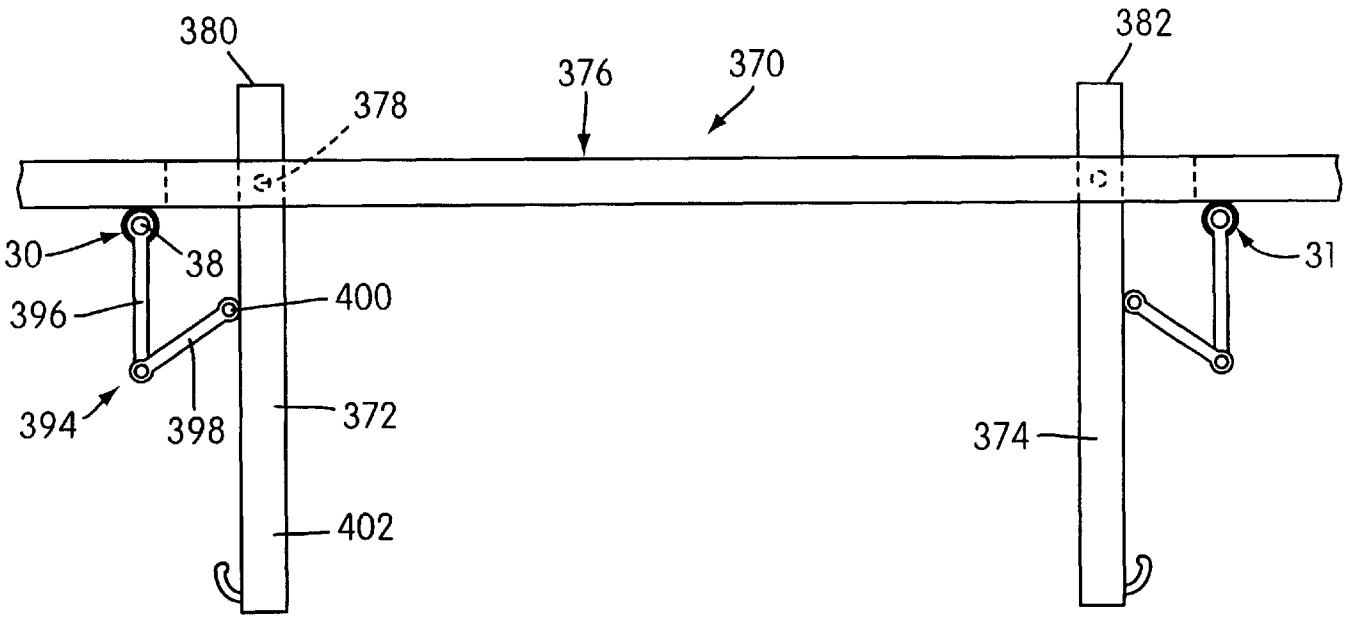
FIG. 16 is a view similar to FIG. 15 except showing the door panels in an open position.

An axial operator 30 associated with door panel 372 is mounted on the adjacent vertically extending jamb 392 of the frame assembly 376. The axial operator 30 is mounted on the jamb 392 such that it is positioned generally forwardly and slightly outwardly (see particularly FIGS. 14 and 15) of the opening 16 provided in the wall 18. This outward and forward positioning allows the door manufacturer to construct the frame assembly 376 to maximize the size of the doorway because the components of the door opening and closing mechanism are small and mounted on the outside of frame assembly 376. Door moving structure 394 is provided in the form of a linkage comprising a main pivot arm 396 and a compensator arm 398 pivotally mounted to the free end of the main pivot arm 396. The main arm 396 is rigidly mounted to the operator output member 38 of the axial operator 30 and the compensator arm 398 is pivotally mounted between the arm 396 and a bracket 400 on the top rail 402 of the door panel 372 for opening and closing pivotal movement as illustrated in FIGS. 15 and 16.

Figure 17:
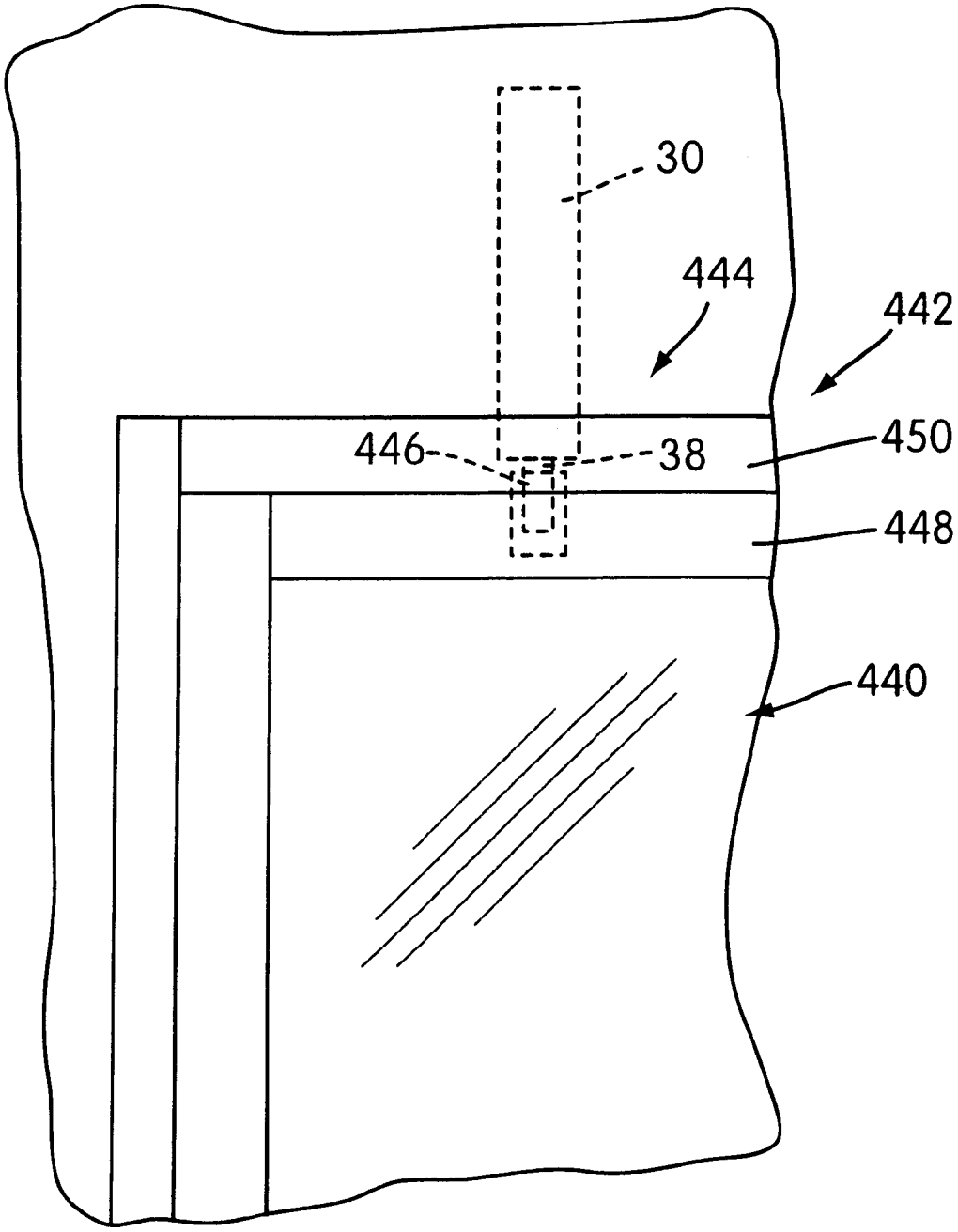
FIG. 17 is a fragmentary view showing an axial operator mounted partially within a header of a frame assembly of a balanced-type door assembly and extending upwardly therefrom into the interior cavity of a wall above the door assembly.

FIG. 17 shows an alternative arrangement for powering opening and closing movement of a balanced door panel 440 of a balanced door assembly 442. The arrangement of the axial operator 30 with respect to the door panel 440 in FIG. 17 is similar to the arrangement shown in FIG. 13 for the hinge door panel. The door panel 440 is hinged to the door frame assembly 444 by a vertically extending pivot shaft 446 that is rigidly secured to the top rail 448 of the door panel 440 and pivotally mounted within the header 450 of the frame assembly 444. The vertically extending pivot shaft 446 supports the weight of the door panel 440. The rotational axis of the operator output member 38 of the axial operator 30 is axially aligned with (i.e., co-extensive) the vertical pivot axis of the pivot shaft 446. The pivot shaft 446 is fixedly connected to the operator output member 38 so that power operated rotation of the operator output member 38 pivots the door panel 440 about its axis between open and closed positions. The pivot shaft 446 thereby can be considered to provide the door moving structure for the door assembly 442.

Figure 18:
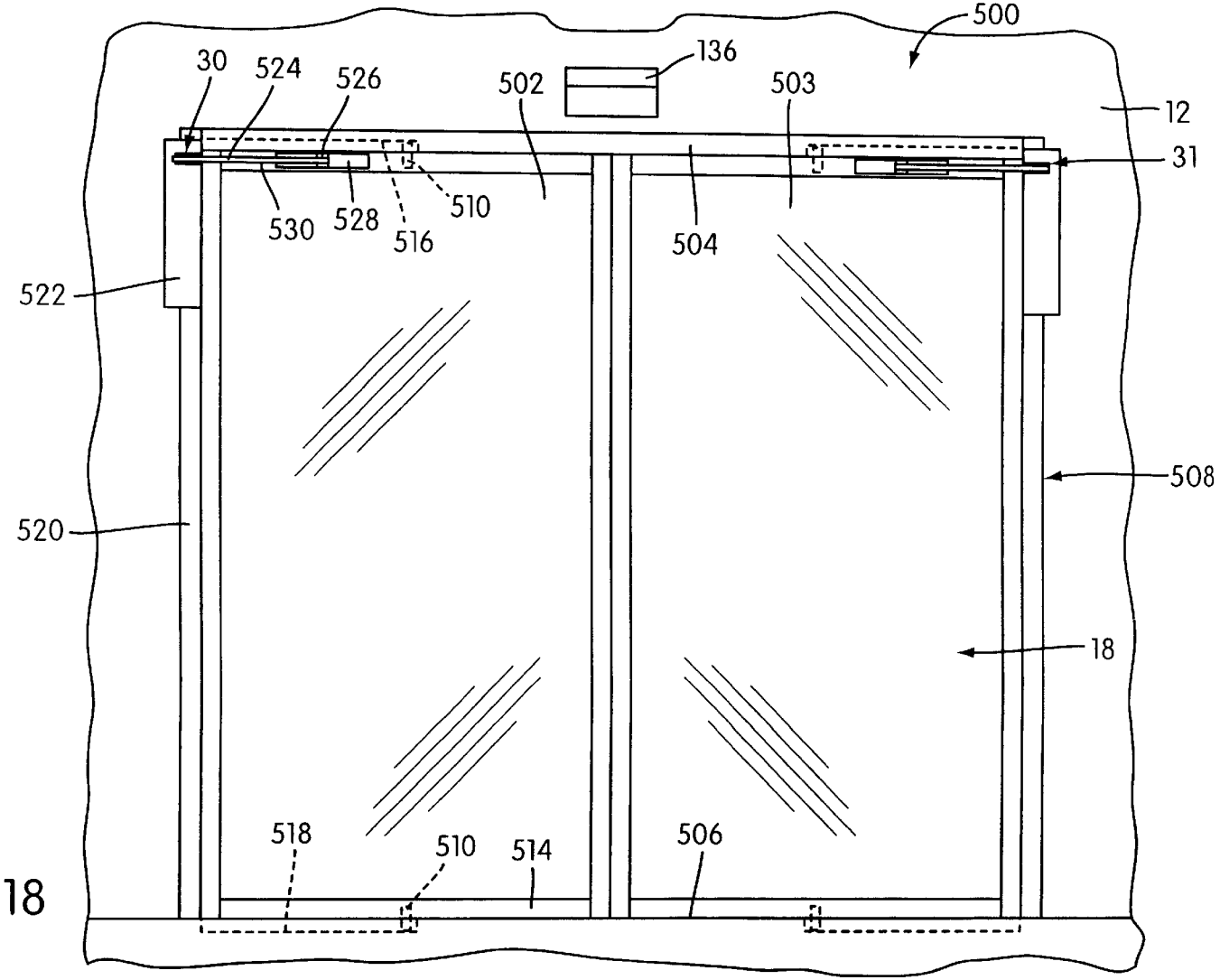
FIG. 18 is a front elevational view of a folding and swinging-type (also referred to as a swing-slide type) door assembly constructed according to the principles of the present invention.
Figure 19:
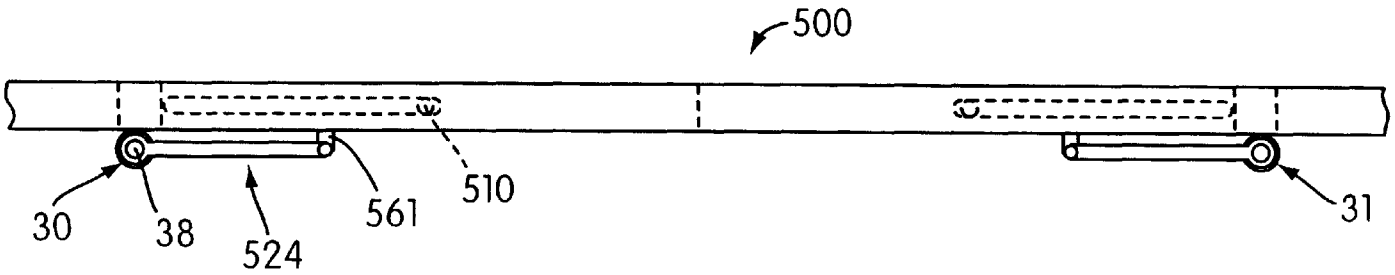
FIG. 19 is a top plan view of the folding and swinging-type door assembly of FIG. 18 with the cover members over the axial operators removed showing a plurality of door panels thereof in a close position.
Figure 20:
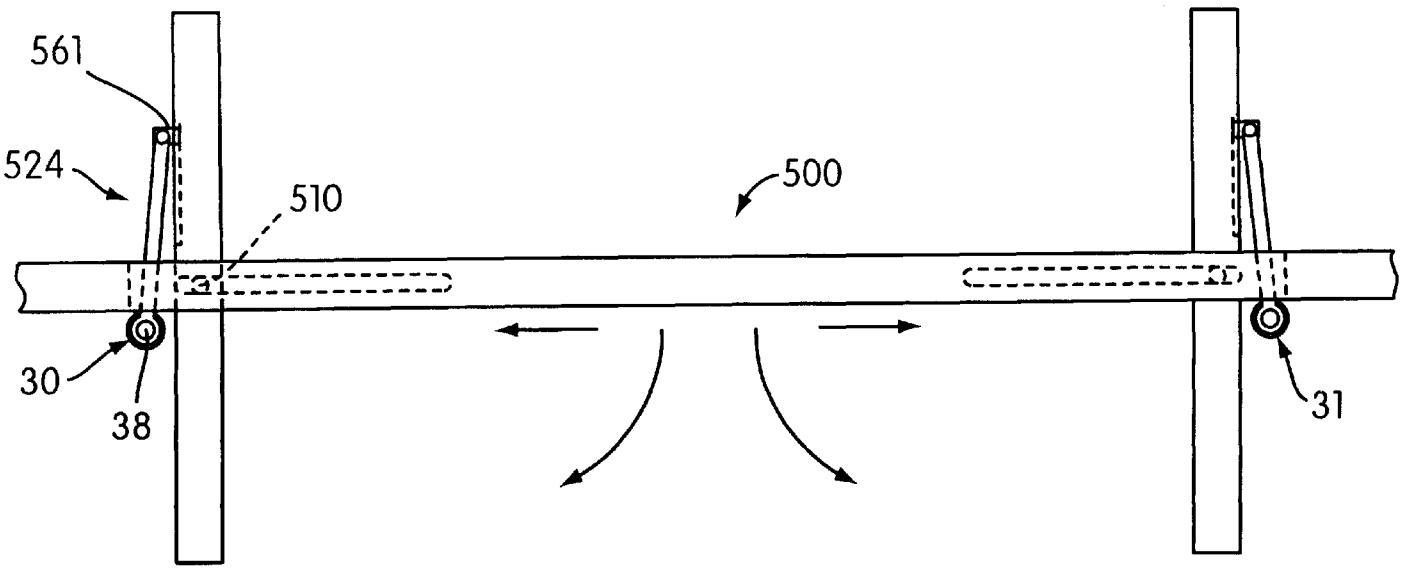
FIG. 20 is a view similar to FIG. 19 except showing the door panels in an open position.

A swinging and folding door assembly 500 arrangement (also referred to as a swing-slide door arrangement) is shown in FIGS. 18–20. The door panel 502 (paired with door panel 503 of mirror image construction) is pivotally mounted between the header 504 and the base 506 of the frame assembly 508 by a pair of generally vertically extending pivot shafts 510 that are fixedly mounted to the upper and lower rails 512, 514, respectively, of the door panel 502. The pivot shafts 510 are pivotally and slidably mounted in respective slots 516, 518 formed in the header 502 and the base 506. The axial operator (not shown in FIG. 18 but shown in FIGS. 19 and 20) is mounted on an exterior portion of a vertical jamb 520 adjacent the door panel 502. Because the door panel 502 is pivotally mounted at its center for pivotal movement between open and closed positions, it is desirable to move the door panel 502 in an outward direction toward its adjacent frame assembly jamb as the panel is pivoting open to maximize the usable area of the doorway 18.

The axial operator is normally covered by a cover member 522. A main arm member 524 (which provides the door moving structure for the door assembly 500) is fixedly mounted to the operator output member of the axial operator at one end and is pivotally mounted to a generally vertically extending roller 526 member at the opposite end. The roller 526 is disposed in a slot 528 in the top rail 512 of the door panel 502. The arm member 524 extends outwardly from a narrow horizontally extending opening 530 the extends the length of the slot 528. It can be appreciated from a comparison of FIGS. 19 and 20 which show top views of the door assembly 500 that when the axial operator 30 is energized, the main arm member 524 swings (i.e., pivots) the door panel 502 in an opening direction about the vertically extending pivot shafts 510 and simultaneously slides the vertically extending pivot shafts 510 along the slots 516, 518 toward the adjacent jamb 520.

Figure 21:
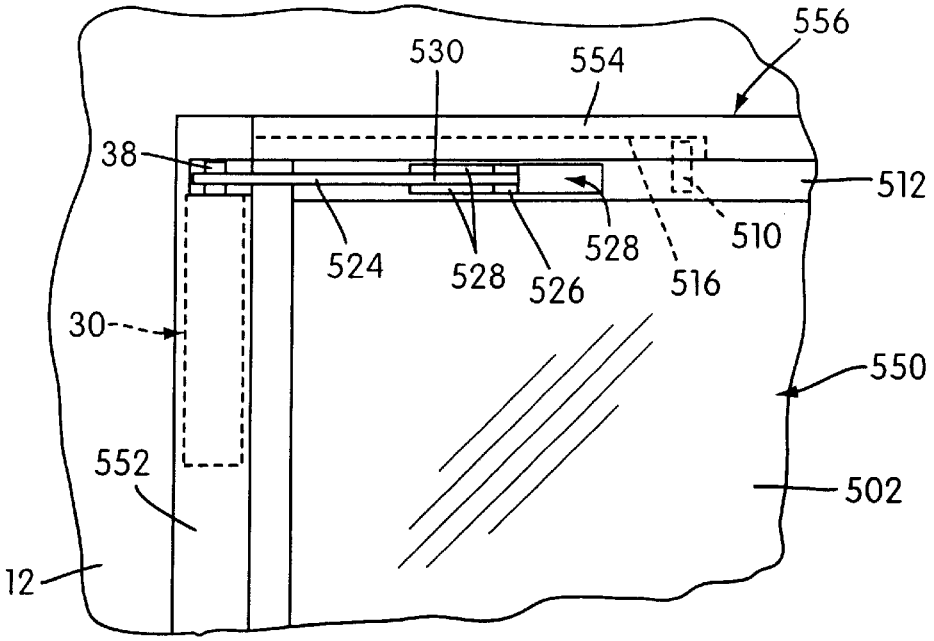
FIG. 21 is a fragmentary view of a folding and swinging-type door assembly showing an axial operator thereof mounted within a vertically extending jamb of the frame assembly.
Figure 22:
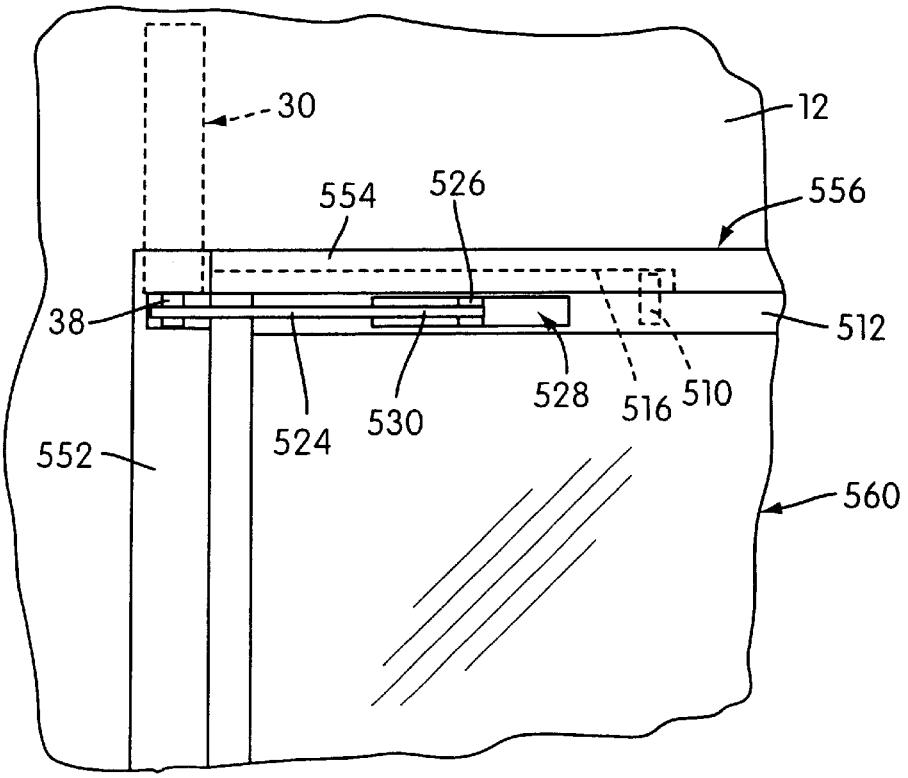
FIG. 22 is a view similar to FIG. 21 except showing the axial operator extending upwardly from the jamb into an interior portion of a wall adjacent the door assembly.

FIGS. 21 and 22 show alternative arrangements for mounting the axial operator 30 in a folding and swinging door assembly of the type shown in FIGS. 18–20. FIGS. 21 and 22 show that the axial operator 30 can be mounted in the jamb 552 (see door assembly 550 of FIG. 21) or partially in the jamb 552 and partially in the wall 12 above the header 554 of the door frame assembly 556 in a balanced door of the folding and swinging-type (see the door assembly 560 of FIG. 22). The main arm members 524 and 562 of the door assemblies 500, 550 and 560 are mounted to the roller 510 by an ancillary arm 561 in a manner best appreciated from FIG. 19. The operation of the door assemblies 550 and 560 can be understood from the operation of the door assembly 500. Specifically, the basic operation of the main arm members, the various slots, the rollers and the vertically extending pivot shafts in FIGS. 21 and 22 is essentially identical to the operation described above in connection with FIGS. 18–20. Consequently, these structures are given identical reference numbers in FIGS. 18–22 and the folding and swing door assemblies 550 and 560 will not be further considered.

It is within the scope of the invention to provide an embodiment of the door assembly 560 in which the header 554 of the frame assembly 556 (see FIG. 22) is constructed to have sufficient vertical height to contain the entire length of the axial operator 30.

Sliding Door Assemblies

Figure 23:
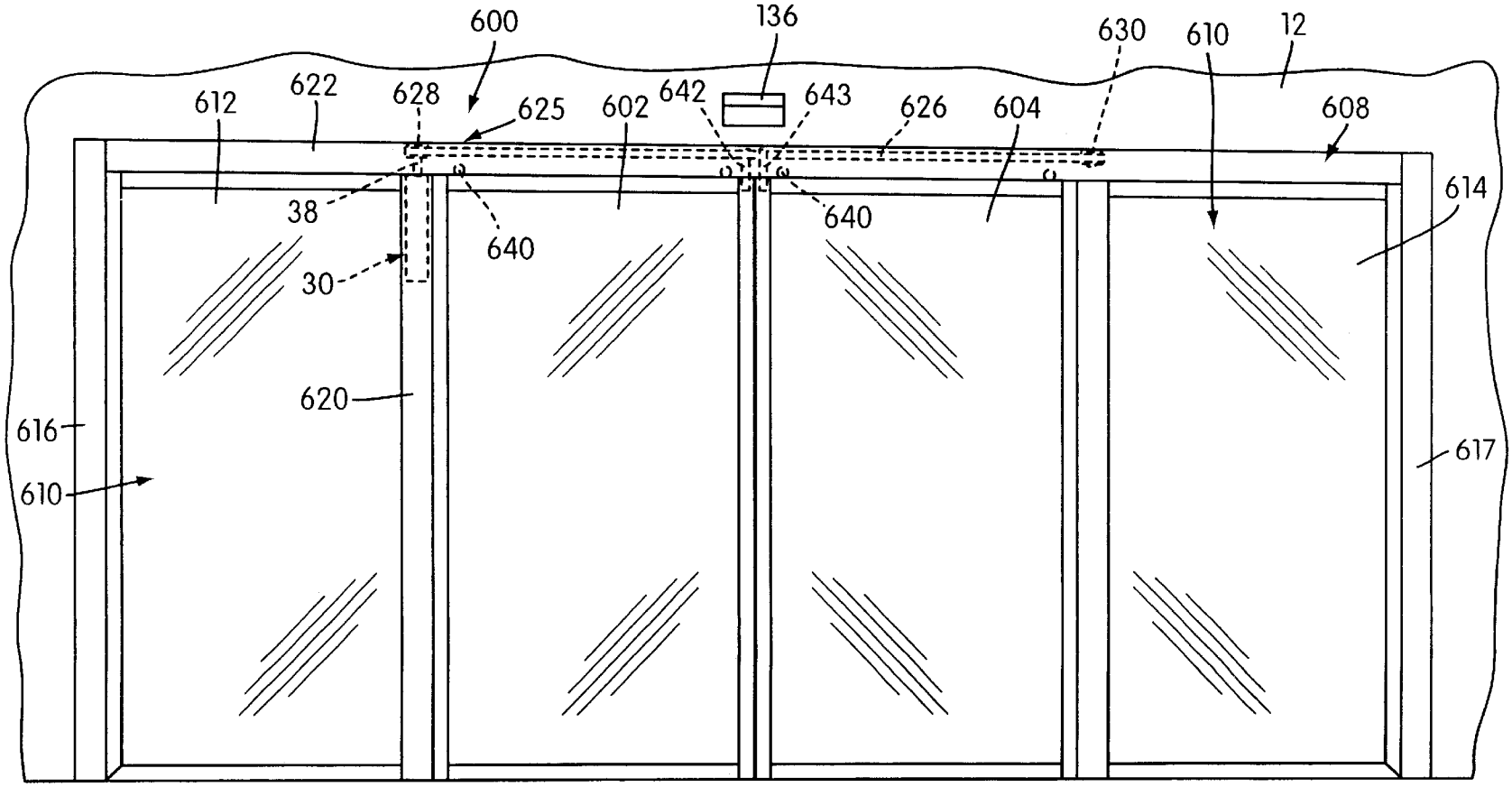
FIG. 23 is a front elevational view of a sliding-type door assembly constructed according to the principles of the present invention.
Figure 24:
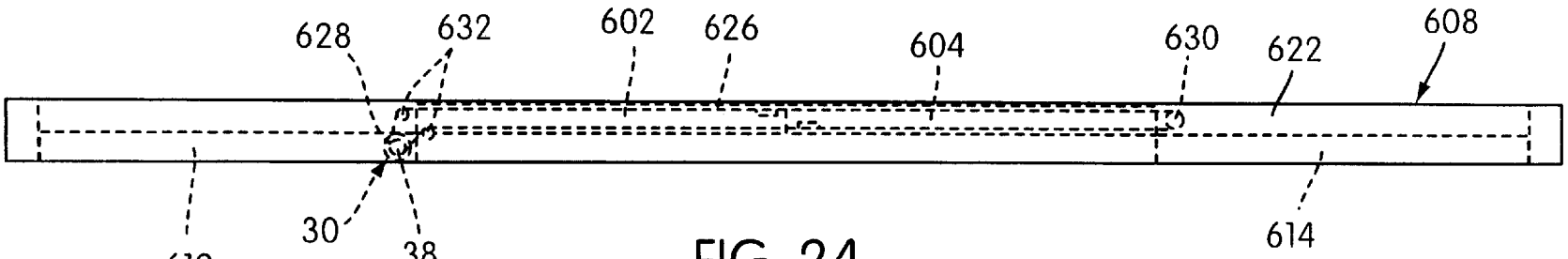
FIG. 24 is a top plan view of the sliding-type door assembly of FIG. 23.
Figure 25:
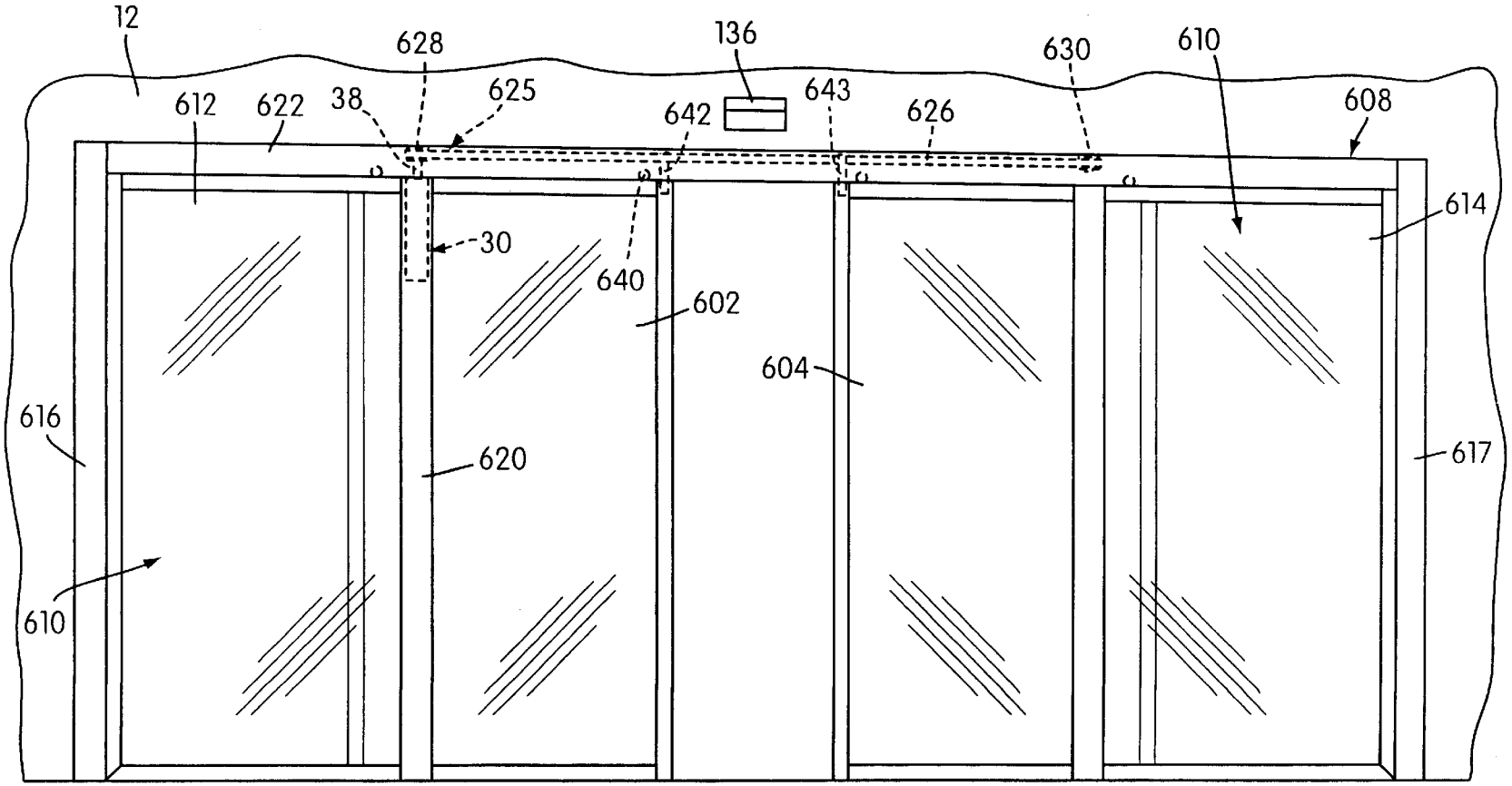
FIG. 25 is a view similar to the view of FIG. 23 except showing a plurality of sliding door panels of the door assembly in a partially open position.

FIGS. 23–28 show various sliding door arrangements that incorporate one or more axial operators to power the sliding movement of one or more door panels. FIGS. 23–25 show a sliding door assembly 600 in which a pair of movable door panels 602, 604 are mounted in the center of a frame assembly 608 in a doorway 610. A pair of stationary door panels 612, 614 are mounted on opposite ends of the frame assembly 608 adjacent respective jambs 616, 617. The central door panels 602, 604 are moved between open and closed positions by a single axial operator 30 mounted within an upper portion of a vertically extending stile 620 of a stationery door panel 612. The operator output member 38 of the axial operator 30 extends upwardly into the header 622 of the frame assembly 608 and is operatively connected with a door moving structure in the form of a horizontally extending belt and pulley system 625 mounted in the header 622.

A belt 626 in the form of a closed continuous loop is mounted between a pulley 628 fixedly mounted on the operator output member 38 and a support pulley 630 rotatably mounted in a bracket that is in turn mounted within the header 622, as shown in FIG. 23. As shown in FIG. 24, the movable central panels 602, 604 are mounted in a track that is adjacent the stationery panels 612, 614 to allow sliding movement of the movable panels 602, 604 past the stationery panels 612, 614. A set of guide rollers 632 are provided in the header 622 which function to maintain the length of the belt 626.

Each door panel 602, 604 is mounted for sliding movement between open and closed door panel positions by a plurality of door support rollers 640 that are rollingly supported and guided by a track (not shown) formed in a well-known manner within the header 622. A vertically extending attachment member 642, 643 is rigidly secured to each door panel 602, 604, respectively, and extends upwardly therefrom. The free end of each attachment member 642, 643 is secured to a respective side of the belt 626 so that rotation of the belt 626 about the pulleys moves to door panels 602, 604 simultaneously in opposite directions to open and close the same.

One skilled in the art can appreciate that the structure of the door panels 602, 604, the manner in which they are mounted for sliding movement within the frame assembly 608 and the manner in which they are connected to the belt 626 for opening and closing movement may be conventional. The broad principal intended to be taught by FIGS. 23–25 is that the axial operator can be mounted in a location other than inside the header, specifically in a portion of the frame assembly 14 below the header, thereby minimizing the vertical extent of the header and maximizing the vertical height of the doorway 610. One skilled in the art will understand that each sliding door panel is typically pivotally mounted in a frame or carrier that is in turn slidingly or rolling mounted to the track within the header of the frame assembly. This construction is well known and allows the door panels to be pivoted open if the doors are closed and the door panels have to be opened in an emergency. The frame is not shown in order to simplify the drawings and to more clearly show the manner in which the axial operator(s) are mounted in the door assembly. It can be understood, however, that it is within the scope of the invention to provide a door panel carrier or frame on any of the slide doors shown and described in the present application and that the use of such a carrier or frame is entirely compatible with the use of an axial operator(s) to power the opening and closing movement of the door panels.

The embodiment of the door assembly shown in FIGS. 23–25 is exemplary only and not intended to limit the scope of the invention. It is within the scope of the invention, for example, to open and close the door panels 602, 604 using two axial operators operatively connected to a single belt and pulley system. A second axial operator, for example, may be provided in the other stationery panel 614 in a manner similar to the mounting of the axial operator 30 in the first stationery panel 612. Alternatively, the single axial operator in FIG. 25 could be mounted to have a vertical orientation that is opposite the vertical orientation shown therein. Specifically, the axial operator could be mounted such that the length thereof extends upwardly from the header into the cavity of the wall and with the operator output member extending generally vertically downwardly to engage the motor-driven pulley.

It can be appreciated that the arrangement shown in FIGS. 23–25 minimizes the vertical extent of the header 622 because only the pulley and belt system 625 and the rollers on the door panels 602, 604 are contained within the header 622 and because the mechanized portion, i.e., the axial operator 30, (and optionally the electrical system including the controller) may be provided in portions of the frame assembly and/or portions of the door panels below the header 622.

Figure 26:
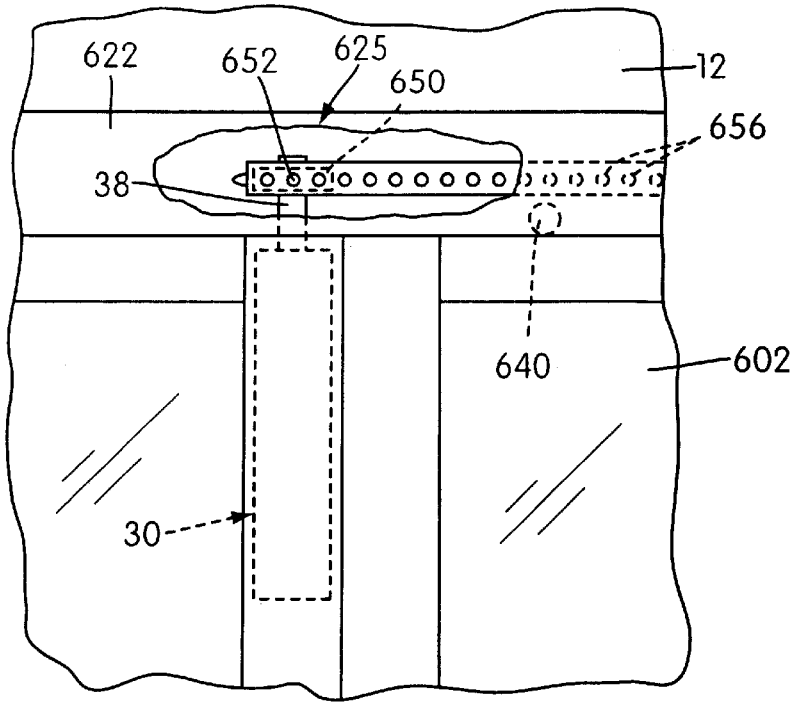
FIG. 26 is a fragmentary view of a sliding type door assembly showing an example of a way in which an axial operator of the door assembly can be operatively mounted to door moving structure of the assembly to affect sliding door movement of the door panels thereof.

FIG. 26 shows an alternative arrangement to the belt and pulley system shown in FIGS. 23–25. Specifically, a pulley-like support member 650 having a plurality of circumferentially spaced, radially extending projections 652 is mounted on the operator output member 38 of the axial operator 30 and a continuous loop belt 654 that is provided with a series of appropriately spaced apertures 656 is mounted on the support member 650 in belt-driving relation therewith. It can be understood that this arrangement is a variation of the belt and pulley arrangement 625 shown in FIGS. 23–25 and is advantageous because it prevents slippage of the belt 654 with respect to the pulley-like support member 650 when a particularly heavy door panel (or panels) is being moved by the axial operator.

Figure 27:
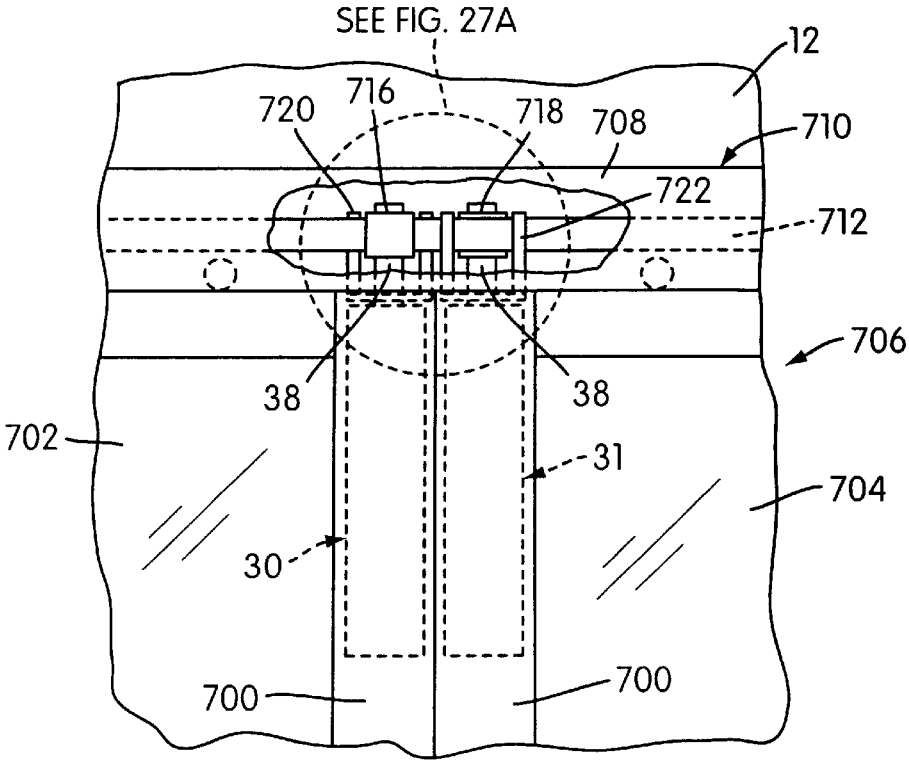
FIGS. 27 and 28 show alternative embodiments of a sliding door assembly in which an axial operator is mounted in each sliding door panel of the assembly and is operatively connected with door moving structure of the assembly.
Figure 27A:
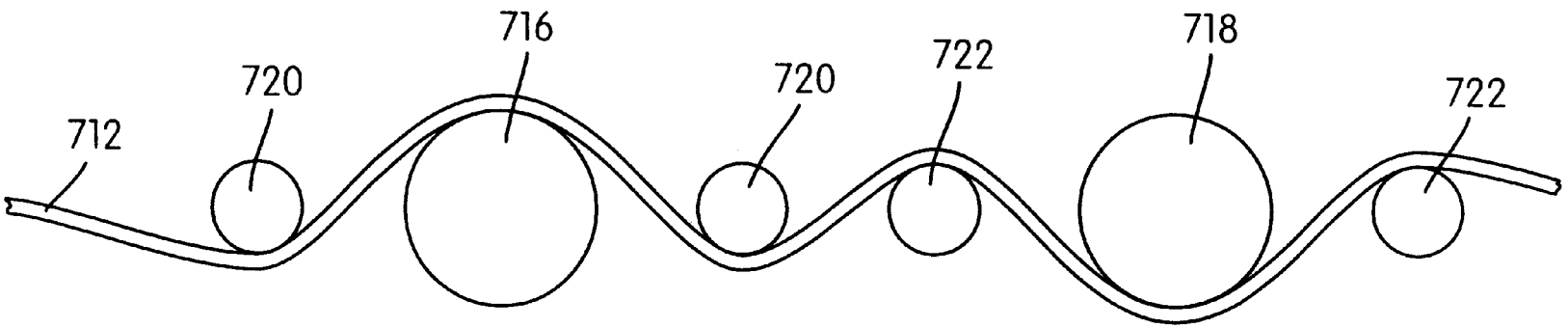
Figure 28:
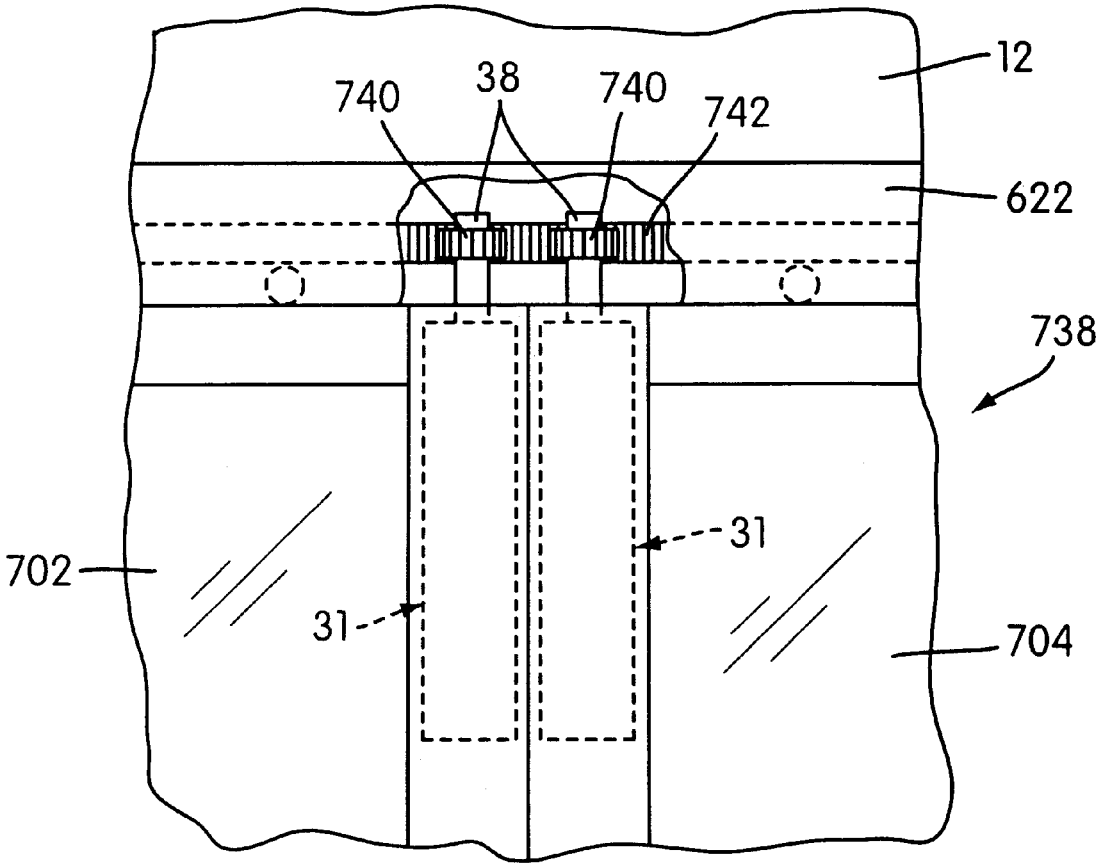
Figure 29:
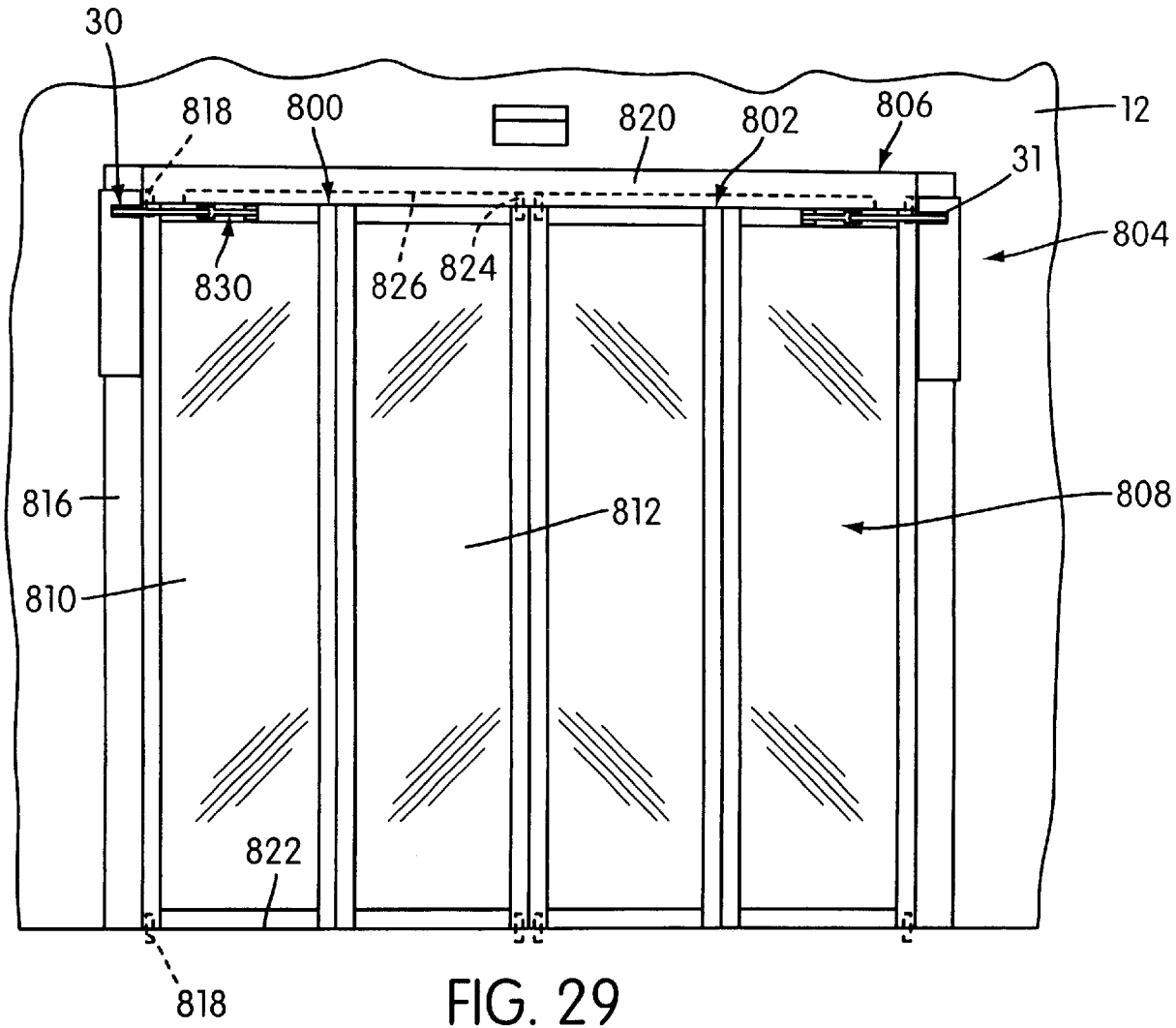
FIG. 29 is a front elevational view of a bi-folding-type door assembly constructed according to the principles of the present invention.

FIGS. 27 and 28 show that the axial operator 30 can be mounted directly in the respective door panels of a door assembly and operatively connected with appropriate structure in the header to provide for door movement when the axial operator is energized. With specific reference to FIG. 27, an axial operator 30 is mounted in the vertically extending stile 700 of each door panel 702, 704 of a door assembly 706 such that the operator output member 38 thereof extends upwardly into the header 708 of the frame assembly 710. A stationery or fixed belt 712 is provided in the header 708. The belt 712 is held in frictional engagement with a pulley 716, 718, respectively, mounted on the operator output members 38 by respective pairs of side rollers 720, 722. The relation between the pulleys 716, 718, the associated side rollers 720, 722 and the belt 712 is best understood from the schematic top view of FIG. 27A.

When an axial operator 30 or 31 is energized and the operator output member 38 thereof rotates in an opening direction (it can be understood that the opening directions of the two axial operators 30, 31 are opposite to one another), the rotation of the respective pulley in frictional engagement with the stationary belt 712 causes the pulley to roll along the belt, which in turn causes the associated door panel to slide in an opening direction.

A similar arrangement is shown in FIG. 28 except that the operator output members 38 of the axial operators 30, 31 of the sliding door assembly 738 are each provided with a pinion-type gear 740 which is in gear meshing relation with a rack 742 mounted in the header 622. The gear 740 and the rack 742 comprise the door moving structure of the door assembly. Rotation of the operator output member 38 causes the pinion gear 740 to drive the associated door panel 702, 704 between open and closed positions.

One skilled in the art can understand that the embodiment of the sliding door assemblies are exemplary only and not intended to limit the scope of the invention. These examples are intended to illustrate that the axial operator 30 allows the drive motor portions of the sliding door assemblies (and the electrical portions such as the controller) to be mounted in a portions of the door assemblies outside of the respective headers so that the vertical heights of the headers can be minimized. In the examples shown, only the rollers which provide the sliding movement of the door panels and a pulley and/or gear arrangement are provided in the particular header.

Bi-Fold-Type Door Assemblies

Figure 30:
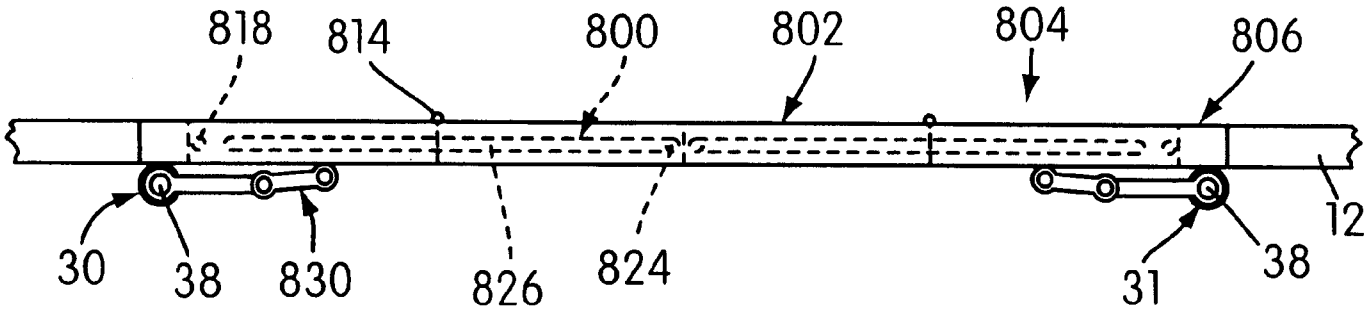
FIG. 30 is a top plan view of the bi-folding-type door assembly of FIG. 29 with the cover members over the axial operators removed and the door panels in their closed positions.

FIGS. 29–34 show various exemplary embodiments of a bi-folding door arrangement that incorporates the axial operator 30. FIG. 30 shows a pair of complementary bi-folding door panels 800, 802 of a bi-folding door assembly 804 mounted within a frame assembly 806 of a doorway 808. Only one bi-folding door panel, panel 800, will be discussed in detail, but it can be appreciated that the door panel 802 is of mirror image construction and that the discussion applies equally to the door panel 802. The bi-folding door panel 800 includes outer and inner panel members 810, 812 that are pivotally mounted to one another at their adjacent vertically extending edges by a vertically extending hinge 814. The outer panel member 810 is pivotally mounted to the adjacent jamb 816 of the frame assembly 806 by pair of vertically extending hinge structures 818 that extend into and are rotatably received within the header 820 and base 822, respectively, of the frame assembly 806.

The outer edge of the inner door panel member 812 is pivotally and slidably mounted to the frame assembly 806 by vertically extending support structures 824 in a well-known manner. The vertically extending support structures 824 extend into the header and base, respectively, of the frame assembly and are pivotally and slidably mounted within respective downwardly opening slots 826, 828 formed in the header and base of the frame assembly 806. The support structures 824 support the end of the door panel 800 opposite the jamb 816 and guide the movement of the door panel 800 between open and closed positions in a well known manner. An axial operator 30 is mounted on the jamb 816 adjacent the outer door panel member 810 and is operatively connected with the outer panel member 810 by an arm member 830 in a manner similar to the way in which the arm member 128 is connected with the hinged door panel 20 of FIG. 1.

Figure 31:
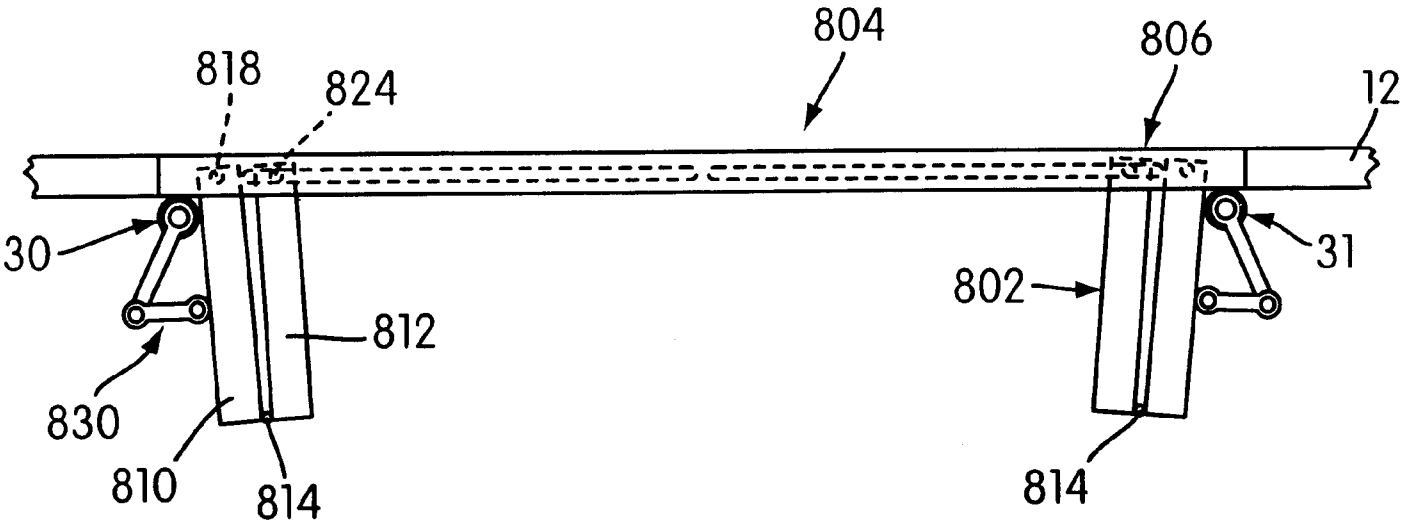
FIG. 31 is a view similar to the view of FIG. 30 except showing a plurality of door panels of the door assembly in their open positions.

It can be understood from FIGS. 30 and 31 that when the motor of the axial operator 30 is energized and rotates in a door opening direction, movement of the arm member 830 pivots the outer door panel member 810 about its vertically extending pivot shafts 818 and simultaneously pivots and slides the inner panel member 812 within the slots 826 and 828. As a result of these movements, the door panels 810, 812 fold together about the hinges 814 as they move into the fully open positions, shown in FIG. 31. Closing movement of the bi-folding door panel can be affected by reversing the rotational direction of the axial operator 30 operator output member 38 by reversing the direction of the current into the motor of the axial operator 30.

Figure 32:
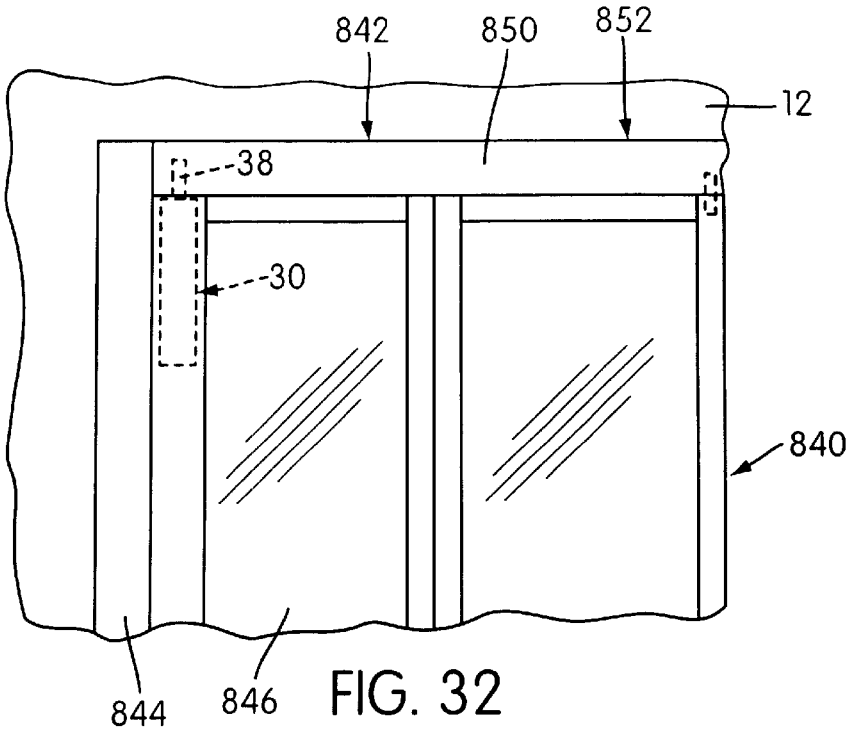
FIGS. 32, 33 and 34 show alternative arrangements for mounting an axial operator in a bi-folding-type door assembly.
Figure 33:
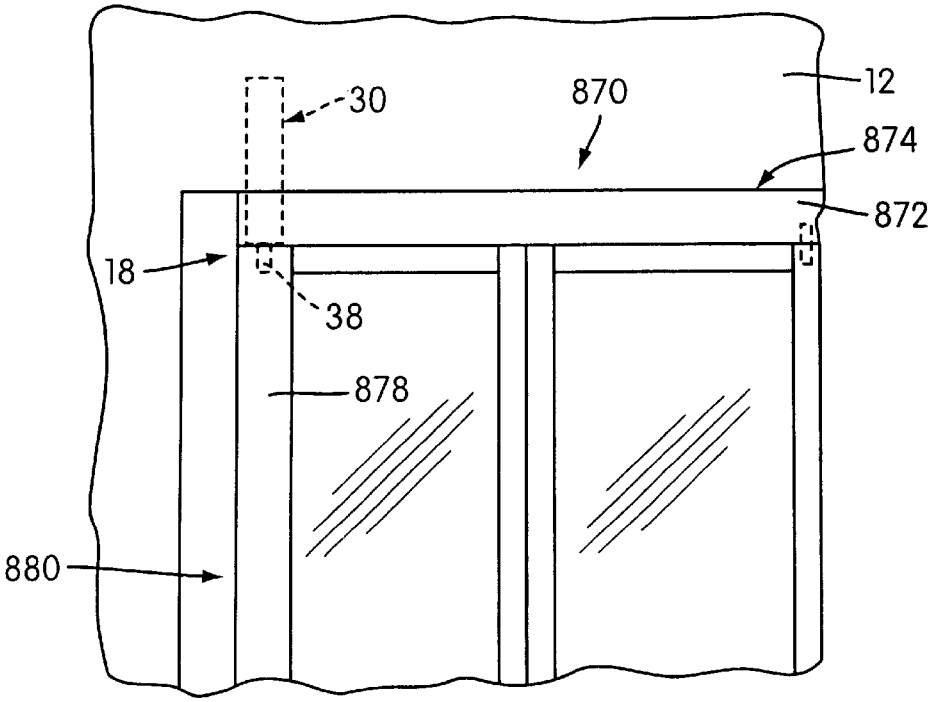

FIGS. 32 and 33 show two alternative embodiments of the bi-folding door assembly. FIG. 32 shows a door assembly 840 in which the axial operator 30 is installed in a bi-folding door panel 842 such that the operator axis of the axial operator is co-extensive with the vertically extending pivot axis of the door panel 842. Specifically, the axial operator 30 is installed in the vertically extending stile 844 of the outer door panel member 846 of the door panel 842 with the operator output member 38 of the axial operator extending upwardly out of the top of the stile 844 and into the header 850 of the door frame assembly 852. The operator output member 38 is fixedly (i.e., non-rotatably) mounted to fixed structure in the header 850 and the casing of the axial operator 30 is fixedly mounted in the stile 844 of the door panel 846 so that powered rotation of the operator output member 38 causes rotation of the outer door panel member and simultaneous folding or unfolding movement of the second door panel member as described above.

FIG. 33 shows an arrangement similar to the arrangement of FIG. 32, except that FIG. 33 shows that the length of the axial operator of a door assembly 870 can extend upwardly into the header 872 of the frame assembly 874 and/or above the header (as shown) and into the interior of the wall 12 adjacent the doorway 18. The output member 38 is fixed to structure within the stile 878 such that rotation of the output member 38 causes rotation of the outer door panel member and simultaneous pivoting and folding movement of the inner panel member.

Figure 34:
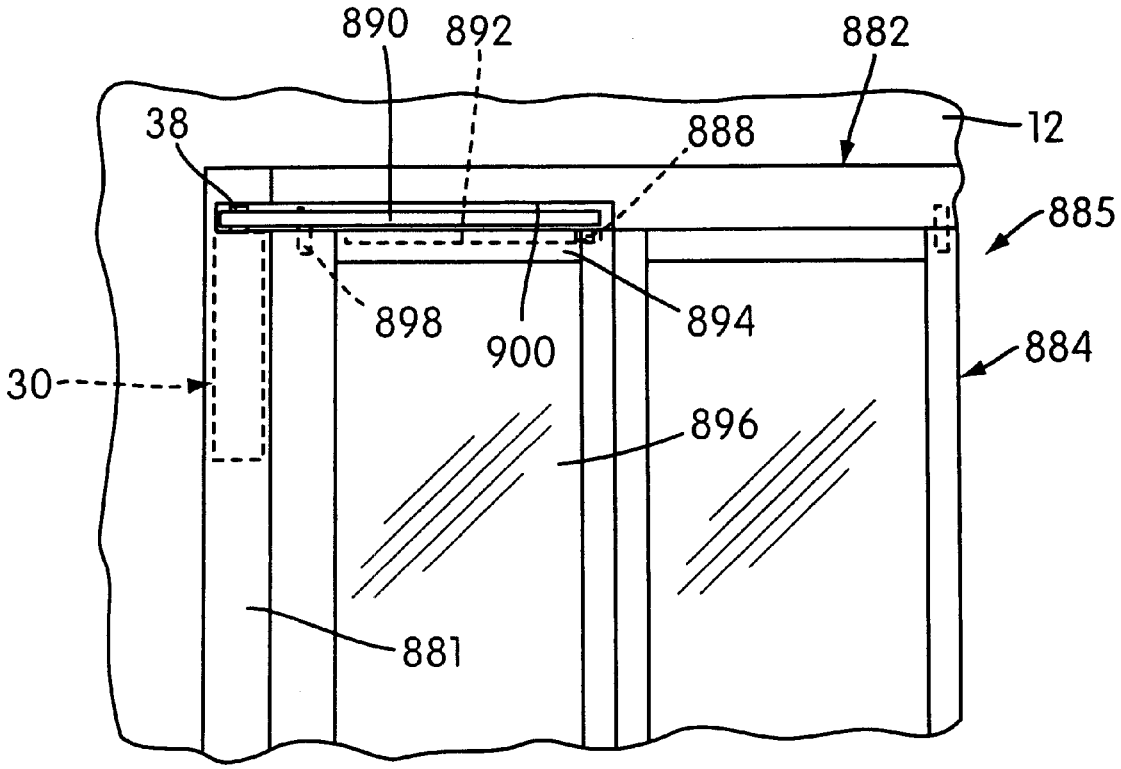

FIG. 34 shows a power operated bi-folding door assembly 885 in which the axial operator 30 is mounted in the jamb 881 of the frame assembly 882 adjacent the door panel 884. This arrangement is similar to the arrangement shown in FIG. 9 and will not be discussed in detail. The operator output member 38 of the axial operator 30 is connected to a door opening roller 888 by a pivot arm 890. One end of the pivot arm 890 is rigidly secured with the operator output member 38 and the opposite end of the pivot arm 890 is rotatably engaged with the roller 888. The roller 888 is disposed in an upwardly opening slot 892 formed in the top rail 894 of the outer door panel member 896 and the pivot arm 890 is disposed in overlying relation to the top edge of the outer door panel member 896 when the door panel 884 is in its closed position. When the door panel is in its closed position and the motor of the axial operator 30 is energized, the operator output member thereof pivots the arm 890 in a door opening direction which in turn pivots the outer door panel member 896 about vertically extending pivot shaft 898. A slot 900 is provided in the header to receive the pivot arm and to allow the same to move between open and closed positions. Pivotal movement of the outer door panel member causes simultaneous pivoting and folding movement of the inner panel member as described above. The arm 890 may be notched or slightly U-shaped to accommodate the pivot shaft 898 when the door panel 884 is in its closed position.

It can be understood that this embodiment of a bi-folding door panel is exemplary only and is not intended to limit the scope of the invention. For example, it is within the scope of the invention to provide an axial operator to power the opening and closing movement of a balanced folding door. It is contemplated to provide a bi-fold door in which opening and closing door panel movement is affected by a motorized hinge of the type shown in FIG. 12 and as described above. Preferably the motorized hinge would be mounted between the panel members of the door panel.

Revolving Door Assemblies

Figure 35:
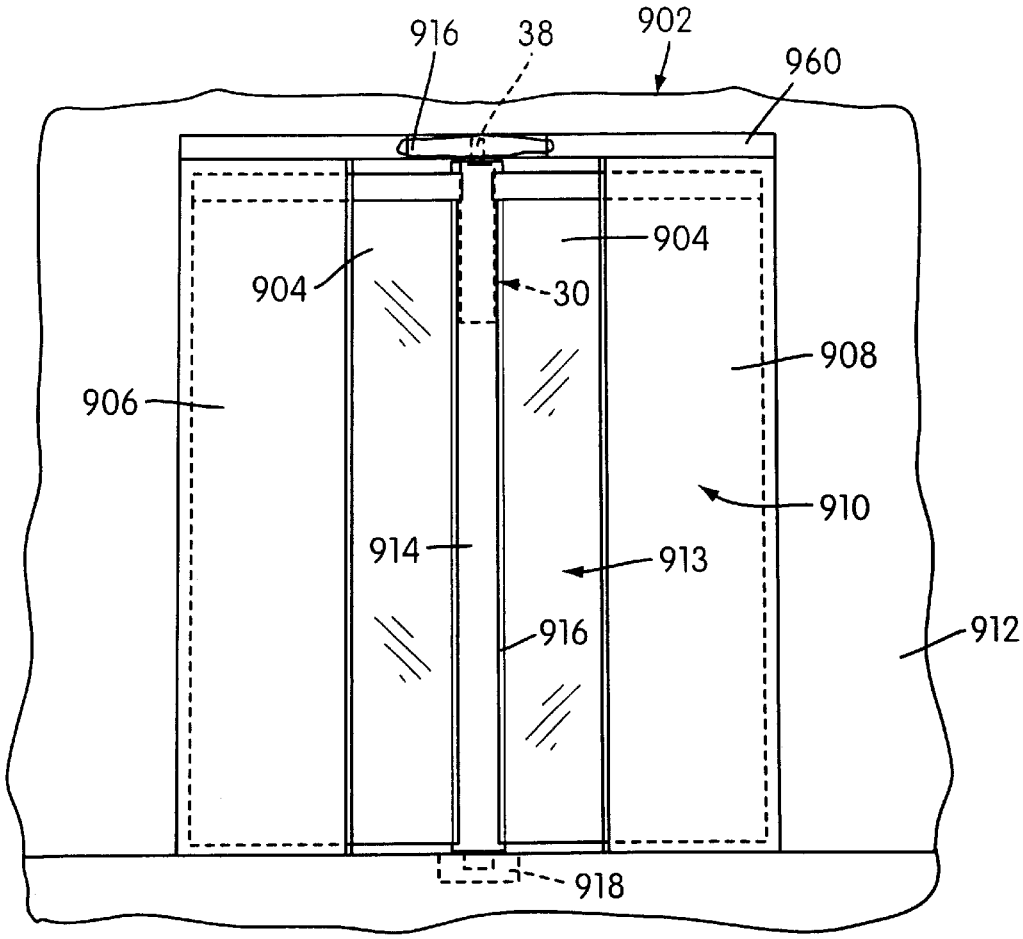
FIG. 35 shows a front elevational view of a revolving-type door assembly constructed according to the principles of the present invention.
Figure 36:
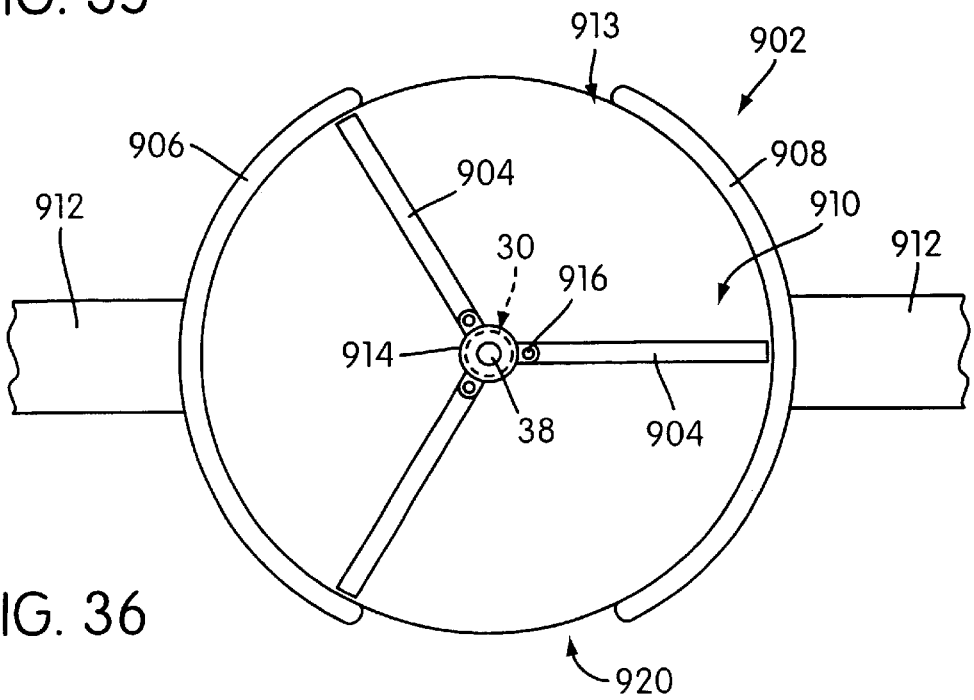
FIG. 36 shows a top plan view of the revolving-type door assembly of FIG. 35.
Figure 37:
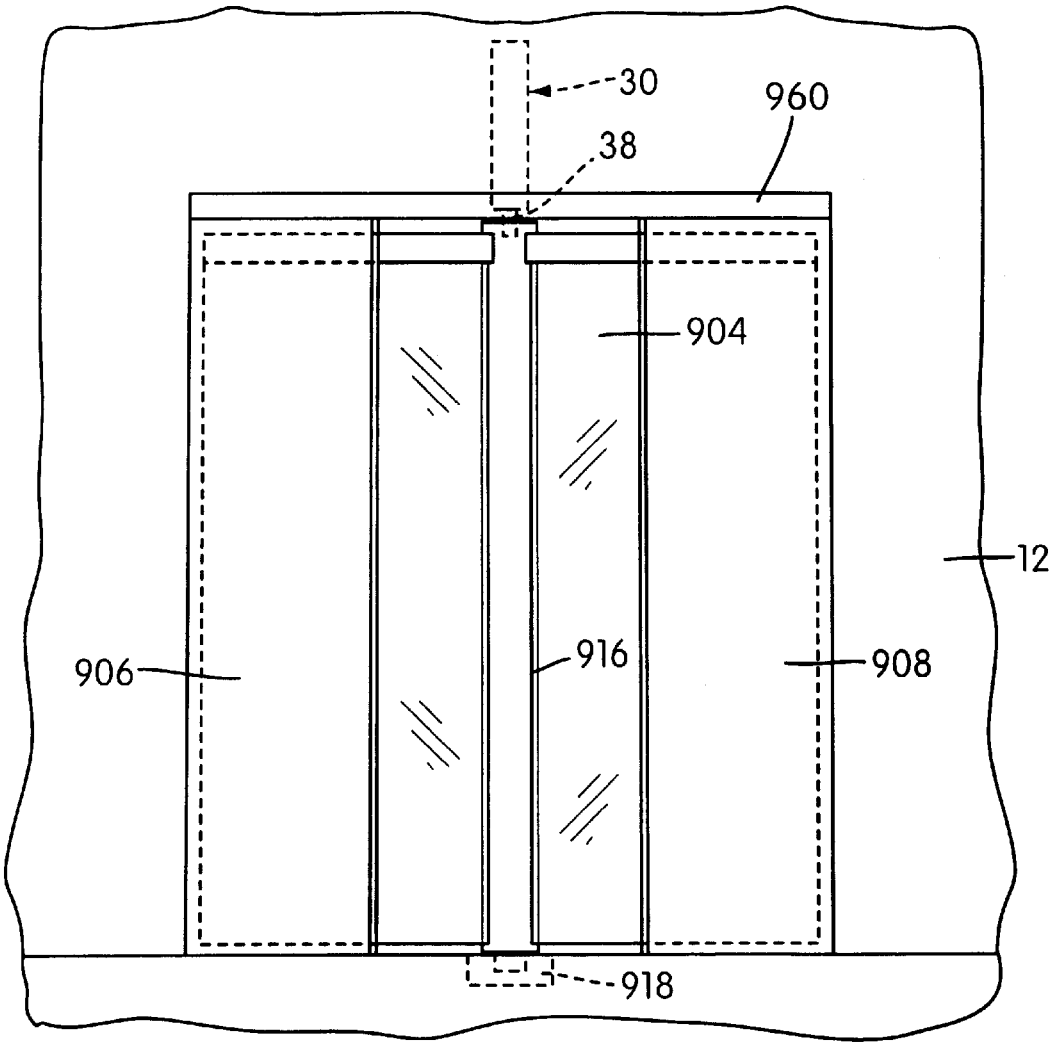
FIG. 37 shows an alternative embodiment of a revolving-type door assembly of the present invention.

FIGS. 35–37 shows an axial operator mounted within embodiments of a revolving-type door assembly 902 to power the revolving movements of the door panels 904 of the revolving door. The revolving door includes a pair of spaced opposing arcuate side wall members 906,908 that extend vertically from the ground surface to the ceiling of a building. The arcuate side wall members 906, 908 are mounted within an opening 910 in a wall 912 of the building that provides a doorway 913 for persons entering and leaving the building. The spacing between the side wall members 906, 908 provide interior and exterior openings for the revolving door assembly 902. A vertically extending central stile 914 is mounted centrally between the side wall members 906, 908 and extends upwardly from the ground to a header above the revolving door. The plurality of radially extending, circumferentially spaced door panels are mounted by releasable brackets 916 to the central stile structure 914 and extend outwardly from the stile in a well-known manner into sliding engagement with the opposing arcuate side wall members 906, 908. The central stile structure 914 is supported for rotational movement by upper and lower bearing assemblies 916, 918, respectively, that are shown schematically in FIG. 35. The bearing assemblies 916, 918 support the weight of the revolving door and provide the rotational mounting of the same between the ground and header. As shown schematically FIG. 35, an axial operator 30 is mounted within a hollow interior portion of the central stile structure 914 and is operatively associated with fixed structure in the upper bearing assembly 916 such that rotation of the operator output member 38 rotates the revolving door panels with respect to the side wall portions at a constant rotational rate. Persons wishing to enter the building walks in an opening (such as opening 920, for example) when the angular position of the door panels 904 allows such entry and then walks behind the moving door panel 904 and exits the revolving door at the opposite opening. The brackets 916 are constructed and arrange to release the door panels supported thereby when a force of predetermined magnitude is applied to the door panel to allow pivotal movement of the panels with respect to the central stile structure 914 in the event of an emergency.

FIGS. 35 and 36 are intended to illustrate the broad teachings of the invention only and are not intended to convey the specific structural details of the construction of the revolving door. Such details are well-known to those skilled in the art. FIGS. 35 and 36 show that the axial operator can be used to power rotational movement of the revolving door while maximizing the vertical height of the doorway. More specifically can be understood that because the axial operator can be mounted in the central stile structure, the vertical extent of the header can be minimized, thereby increasing the usable vertical height of the doorway. This improves the aesthetic appearance of the revolving door.

FIG. 37 shows an alternative arrangement of the revolving door in which the axial operator 30 extends upwardly from the central stile 914 structure in axial alignment therewith. The axial operator 30 (shown schematically) extends into the interior cavity of the building wall 12 above the doorway and through the header into operative connection with the central stile structure 914 of the revolving door. This is exemplary only and not intended to limit the scope of invention. For example it is within the scope of invention to provide a header having sufficient vertical extend to contain the vertical extend of the axial operator.

It can also be appreciated that the electronic portions shown and described for the various door assemblies are exemplary only and not intended to limit the scope of invention. For example, although an infrared detector is shown and described as the means for initiating door panel opening movement, any means, including any known electronic, electromechanical or optoelectromechanical means, known to one skilled in the art can be used to control door panel operation.

While the invention has been disclosed and described with reference with a limited number of embodiments, it will be apparent that variations and modifications may be made thereto without departure from the spirit and scope of the invention. Therefore, the following claims are intended to cover all such modifications, variations, and equivalents thereof in accordance with the principles and advantages noted herein.

What is claimed:

1. A power-operated door assembly comprising:

a frame assembly constructed and arranged to be installed in an opening formed through a building wall, said frame assembly providing a doorway that permits persons to travel from one side of the building wall to the other side of the building wall when said door assembly is installed;

a generally vertically extending pivoting door panel that mounts to said frame assembly for pivotal movement about a generally vertical pivot axis with respect to the doorway of said frame assembly between open and closed positions;

an axial operator comprising:

a rotatable operator output member that rotates about a generally vertically extending operator axis, said operator output member being operatively connected within said door panel such that selective rotation of said operator output member pivots said door panel about said pivot axis as aforesaid;

an electric motor having a rotatable motor output member that rotates about said operator axis, said motor being constructed and arranged to selectively rotate said motor output member about said operator axis;

a planet gear reduction transmission connected between said motor output member and said operator output member, said reduction transmission being constructed and arranged such that said transmission rotates said operator output member at a lower rotational speed than a rotational speed at which said motor rotates said motor output member and applies a higher torque to said operator output member than a torque which said motor applies to said motor output member;

said reduction transmission comprising (a) an orbit gear arranged generally coaxially with respect to said operator axis, (b) a planet gear carrier positioned radially inwardly of said orbit gear and arranged for rotation about said operator axis, said planet gear carrier having a mounting portion offset generally radially from said output axis, and (c) a planet gear rotatably mounted to the mounting portion of said planet gear carrier such that said planet gear rotates about a planet gear axis that extends through said mounting portion generally parallel to said operator axis;

said planet gear being operatively connected to said motor output member and engaged with a radially inwardly facing interior surface of said orbit gear such that rotation of said motor output member rotates said planet gear relative to said planet gear carrier about said planet gear axis which in turn causes said planet gear to roll along the interior surface of said orbit gear in a generally circumferential direction with respect to said operator axis, thereby rotating said planet gear carrier about said output axis at a lower rotational speed and at a higher torque than the rotational speed and torque at which said motor rotates said motor output member;

said planet gear carrier being operatively connected to said operator output member such that rotation of said planet gear carrier as a result of said planet gear being rotated by said motor output member as aforesaid rotates said operator output member as aforesaid to thereby pivot said door panel about said pivot axis; and a controller communicated to the motor of said axial operator, said controller being operable to selectively control operation of said motor so as to selectively cause said motor to rotate said motor output member and thereby rotate said operator output member so as to move said door panel with respect to said doorway as aforesaid.

2. The power-operated door assembly according to claim 1, wherein said axial operator is mounted to said frame assembly externally thereof, said door assembly further comprising a link arm connected between said operator output member and said door panel.

3. The power-operated door assembly according to claim 2, wherein said door panel is a single door panel with a free edge.

4. The power-operated door assembly according to claim 3, wherein said door panel is one panel of a bi-fold door panel assembly including an additional door panel pivotally connected to said door panel.

5. The power-operated door assembly according to claim 2, wherein said pivot axis is located at a vertical stile of said door panel opposite said free edge.

6. The power-operated door assembly according to claim 2, wherein said pivot axis is spaced inwardly from a vertical stile of said door panel opposite said free edge.

7. The power-operated door assembly according to claim 6, wherein said door panel is also slidably mounted to said frame assembly, said door assembly further comprising a link arm connected between said operator output member and said door panel, said link arm and said slidable mounting enabling said axial operator to simultaneously pivot and slide said door panel between said open and closed positions.

8. The power-operated door assembly according to claim 7, wherein said axial operator further comprises a casing enclosing both said motor and said transmission.

9. The power-operated door assembly according to claim 2, wherein said axial operator further comprises a casing enclosing both said motor and said transmission.

10. The power-operated door assembly according to claim 9, wherein said link arm includes two pivotally connected arm portions.

11. The power-operated door assembly according to claim 10, wherein one of said arm portions is fixed to said operator output member and wherein the other of said arm portions is pivotally connected to said door panel.

12. The power-operated door assembly according to claim 10, wherein said door panel is a single door panel with a free edge.

13. The power-operated door assembly according to claim 12, wherein said door panel is one panel of a bi-fold door panel assembly including an additional door panel pivotally connected to said door panel.

14. The power-operated door assembly according to claim 1, wherein said axial operator is received within the vertical stile of said door panel and said operator output member is fixed to said frame assembly.

15. The power-operated door assembly according to claim 14, wherein said door panel is a single door panel with a free edge.

16. The power-operated door assembly according to claim 15, wherein said door panel is one panel of a bi-fold door panel assembly including an additional door panel pivotally connected to said door panel.

17. The power-operated door assembly according to claim 1, wherein said axial operator is included in a hinge assembly including two pivotable parts pivotally coupled together, said operator output member being connected to said pivotable parts and being constructed and arranged such that rotation of said axial output member affects pivotal movement of said two parts to pivot said door panel about said pivot axis.

18. The power-operated door assembly according to claim 17, wherein said door panel is a single door panel with a free edge, one of said two pivotable parts being fixed to said door panel and the other of said two pivotable parts being fixed to said frame assembly.

19. The power-operated door assembly according to claim 17, wherein said door panel is one panel of a bi-fold door panel assembly including an additional door panel pivotally connected to said door panel.

20. The power-operated door assembly according to claim 19, wherein said door panel is pivotably connected at one edge to said frame assembly and an opposite edge to said additional door panel, one of said two pivotable parts of said hinge assembly being fixed to said door panel and the other of said two pivotable parts being fixed to said frame assembly.

21. The power-operated door assembly according to claim 17, wherein said axial operator further comprises a casing enclosing both said motor and said transmission.

22. The power-operated door assembly according to claim 1, wherein said axial operator is fixed to said frame and extends upwardly therefrom so as to be received in a cavity of a building wall in which said door assembly is installed.

23. The power-operated door assembly according to claim 22, wherein said operator output member is fixed to said door panel such that rotation of said operator output member pivots said door panel.

24. The power-operated door assembly according to claim 23, wherein said pivot axis is spaced inwardly from a vertical stile of said door panel opposite said free edge.

25. The power-operated door assembly according to claim 23, wherein said pivot axis is spaced inwardly from a vertical stile of said door panel opposite said free edge.

26. The power-operated door assembly according to claim 1, wherein said axial operator is fixed to one of said frame assembly and said door panel and the other of said frame assembly and said door panel includes a groove, said door assembly further comprising a link arm having an end portion fixed to said operator output member and an opposite end portion received in said groove.

27. The power-operated door assembly according to claim 26, wherein said axial operator is fixed to said frame assembly and said door panel includes said groove.

28. The power-operated door assembly according to claim 27, wherein said axial operator is received within a vertical stile of said frame assembly.

29. The power-operated door assembly according to claim 26, wherein said axial operator is fixed to said door panel and said frame assembly includes said groove.

30. The power-operated door assembly according to claim 29, wherein said axial operator is received within a vertical stile of said door panel.

31. The power-operated door assembly according to claim 30, wherein said door panel is a single door panel with a free edge.

32. The power-operated door assembly according to claim 26, wherein said door panel is one panel of a bi-fold door panel assembly including an additional door panel.

33. A power-operated hinge assembly for use in a door assembly, said door assembly comprising: a frame assembly constructed and arranged to be installed in an opening formed through a building wall, said frame assembly providing a doorway that permits persons to travel from one side of the building wall to the other side of the building wall when said door assembly is installed; a generally vertically extending door panel that mounts to said frame assembly, said door panel being constructed and arranged to move with respect to the doorway of said frame assembly; said hinge assembly comprising:

two pivotable parts pivotally coupled together, said pivotable parts being constructed and arranged for mounting to said door assembly such that one of said pivotable parts is connected to said door panel for pivotal movement along with said door panel;

an axial operator comprising:

a rotatable operator output member that rotates about a generally vertically extending operator axis, said operator output member being connected to said pivotable parts and being constructed and arranged such that rotation of said axial output member affects pivotal movement of said two parts to enable pivoting of said door panel about said pivot axis between open and closed positions;

an electric motor having a rotatable motor output member that rotates about said operator axis, said motor being constructed and arranged to selectively rotate said motor output member about said operator axis;

a planet gear reduction transmission connected between said motor output member and said operator output member, said reduction transmission being constructed and arranged such that said transmission rotates said operator output member at a lower rotational speed than a rotational speed at which said motor rotates said motor output member and applies a higher torque to said operator output member than a torque which said motor applies to said motor output member;

said reduction transmission comprising (a) an orbit gear arranged generally coaxially with respect to said operator axis, (b) a planet gear carrier positioned radially inwardly of said orbit gear and arranged for rotation about said operator axis, said planet gear carrier having a mounting portion offset generally radially from said output axis, and (c) a planet gear rotatably mounted to the mounting portion of said planet gear carrier such that said planet gear rotates about a planet gear axis that extends through said mounting portion generally parallel to said operator axis;

said planet gear being operatively connected to said motor output member and engaged with a radially inwardly facing interior surface of said orbit gear such that rotation of said motor output member rotates said planet gear relative to said planet gear carrier about said planet gear axis which in turn causes said planet gear to roll along the interior surface of said orbit gear in a generally circumferential direction with respect to said operator axis, thereby rotating said planet gear carrier about said output axis at a lower rotational speed and at a higher torque than the rotational speed and torque at which said motor rotates said motor output member;

said planet gear carrier being operatively connected to said operator output member such that rotation of said planet gear carrier as a result of said planet gear being rotated by said motor output member as aforesaid rotates said operator output member as aforesaid to thereby pivot said pivotable parts relative to one another.

34. A power-operated door assembly comprising:

a frame assembly constructed and arranged to be installed in an opening formed through a building wall, said frame assembly providing a doorway that permits persons to travel from one side of the building wall to the other side of the building wall when said door assembly is installed;

a generally vertically extending door panel that mounts to said frame assembly, said door panel being constructed and arranged to move with respect to the doorway of said frame assembly;

an axial operator comprising:

a rotatable operator output member that rotates about a generally vertically extending operator axis, said operator output member being operatively connected within said door assembly such that selective rotation of said operator output member moves said door panel with respect to the doorway of said frame assembly as aforesaid;

an electric motor having a rotatable motor output member that rotates about said operator axis, said motor being constructed and arranged to selectively rotate said motor output member about said operator axis;

a planet gear reduction transmission connected between said motor output member and said operator output member, said reduction transmission being constructed and arranged such that said transmission rotates said operator output member at a lower rotational speed than a rotational speed at which said motor rotates said motor output member and applies a higher torque to said operator output member than a torque which said motor applies to said motor output member;

said reduction transmission comprising (a) an orbit gear arranged generally coaxially with respect to said operator axis, (b) a planet gear carrier positioned radially inwardly of said orbit gear and arranged for rotation about said operator axis, said planet gear carrier having a mounting portion offset generally radially from said output axis, and (c) a planet gear rotatably mounted to the mounting portion of said planet gear carrier such that said planet gear rotates about a planet gear axis that extends through said mounting portion generally parallel to said operator axis;

said planet gear being operatively connected to said motor output member and engaged with a radially inwardly facing interior surface of said orbit gear such that rotation of said motor output member rotates said planet gear relative to said planet gear carrier about said planet gear axis which in turn causes said planet gear to roll along the interior surface of said orbit gear in a generally circumferential direction with respect to said operator axis, thereby rotating said planet gear carrier about said output axis at a lower rotational speed and at a higher torque than the rotational speed and torque at which said motor rotates said motor output member;

said planet gear carrier being operatively connected to said operator output member such that rotation of said planet gear carrier as a result of said planet gear being rotated by said motor output member as aforesaid rotates said operator output member as aforesaid to thereby move said door panel with respect to the doorway of said frame assembly; and a controller communicated to the motor of said axial operator, said controller being operable to selectively control operation of said motor so as to selectively cause said motor to rotate said motor output member and thereby rotate said operator output member so as to move said door panel with respect to said doorway as aforesaid.

35. The power-operated door assembly according to claim 34, wherein said door panel is a swinging door panel that pivots under power about a generally vertically extending axis between open and closed positions thereof.

36. The power-operated door assembly according to claim 34, wherein said door panel is a sliding door panel that moves under power in a generally rectilinear manner between open and closed positions thereof.

37. The power-operated door assembly according to claim 34, wherein said door panel is part of a revolving door panel assembly that rotates about a revolving axis and that comprises a plurality of said door panels extending generally radially from said revolving axis, said axial operator being mounted to said frame assembly and said revolving door panel assembly being operatively connected to said axial operator such that door operator rotates said revolving door panel assembly about said revolving axis.

38. The power-operated door assembly according to claim 34, wherein said planet gear and the interior surface of said orbit gear each have a plurality of teeth intermeshed with one another.

39. The power-operated door assembly according to claim 34, wherein said planet gear carrier has a plurality of said planet gear mounting portions and wherein said reduction transmission has a plurality of said planet gears each respectively mounted on said planet gear mounting portions.

40. The power-operated door assembly according to claim 34, wherein said reduction transmission has (a) a multiplicity of said planet gear carriers each having a plurality of planet gear mounting portions and (b) a plurality of said planet gears for each planet gear carrier, the planet gears of each plurality thereof being respectively mounted on said planet gear mounting portions of each plurality thereof.

41. An axial operator that is configured for use with a controller that transmits a door moving signal and a door assembly comprising (a) a frame assembly installed in an opening formed through a building wall, said frame assembly providing a doorway that allows persons to travel from one side of the building wall to the other side of the building wall when said door assembly is installed, and (b) a generally vertically extending door panel that mounts to said frame assembly, said door panel being constructed and arranged to be selectively moved with respect to the doorway of said frame assembly, said axial operator comprising:

a rotatable operator output member that rotates about an operator axis, said operator output member being constructed and arranged to be operatively connected within said door assembly such that said operator output axis extends generally vertically and such that rotation of said operator output member about said operator axis moves said door panel with respect to the doorway of said frame assembly as aforesaid;

an electric motor having a rotatable motor output member that rotates about said operator axis, said motor being constructed and arranged to selectively rotate said motor output member about said operator axis;

a reduction transmission connected between said motor output member and said operator output member, said reduction transmission being constructed and arranged such that said transmission rotates said operator output member at a lower rotational speed than a rotational speed at which said motor rotates said motor output member and applies a higher torque to said operator output member than a torque which said motor applies to said motor output member;

said reduction transmission comprising (a) an orbit gear arranged generally coaxially with respect to said operator axis, (b) a planet gear carrier position radially inwardly of said orbit gear and arranged for rotation about said operator axis, said planet gear carrier having a mounting portion offset generally radially from said operator axis, and (c) a planet gear rotatably mounted to the mounting portion of said planet gear carrier such that said planet gear rotates about a planet gear axis that extends through said mounting portion and generally parallel to said operator axis;

said planet gear being operatively connected to said motor output member and engaged with a radially inwardly facing interior surface of said orbit gear such that rotation of said motor output member rotates said planet gear relative to said planet gear carrier about said planet gear which in turn causes said planet gear to roll along the interior surface of said orbit gear in a generally circumferential direction with respect to said operator axis, thereby rotating said planet gear carrier about said output axis at a lower rotational speed and at a higher torque than the rotational speed and torque at which said motor rotates said motor output member;

said planet gear carrier being operatively connected to said operator output member such that rotation of said planet gear carrier as a result of said planet gear being rotated by said motor output member as aforesaid rotates said operator output member as aforesaid to thereby move said door panel with respect to the doorway of said frame assembly;

said motor being adapted to be communicated to the controller so as to receive the door moving signal therefrom and being further adapted to selectively rotate said motor output member in response to receiving said door moving signal to thereby rotate said operator output member so as to move said door panel with respect to said doorway as aforesaid.

42. The axial operator according to claim 41, wherein said planet gear and the interior surface of said orbit gear each have a plurality of teeth intermeshed with one another.

43. The axial operator according to claim 41, wherein said planet gear carrier has a plurality of said planet gear mounting portions and wherein said reduction transmission has a plurality of said planet gears each respectively mounted on said planet gear mounting portions.

44. The axial operator according to claim 41, wherein said reduction transmission has multiplicity of said planet gear carriers each having a plurality of planet gear mounting portions and (b) a plurality of said planet gears for each planet gear carrier, the planet gears of each plurality thereof being respectively mounted on said planet gear mounting portions of each plurality thereof.

* * * * *